US008052442B1

(12) United States Patent
Li et al.

(10) Patent No.: US 8,052,442 B1
(45) Date of Patent: Nov. 8, 2011

(54) LIGHT STRING SYSTEM

(75) Inventors: Zhaoyuan Li, Heyuan (CN); Zou Xin Jiang, Hong Kong (CN)

(73) Assignee: Polygroup Macau Limited (BVI) (VG)

( * ) Notice: Subject to any disclaimer, the term of this patent is extended or adjusted under 35 U.S.C. 154(b) by 0 days.

(21) Appl. No.: 13/181,282

(22) Filed: Jul. 12, 2011

Related U.S. Application Data

(62) Division of application No. 12/582,538, filed on Oct. 20, 2009, now Pat. No. 7,980,871.

(60) Provisional application No. 61/106,668, filed on Oct. 20, 2008.

(51) Int. Cl.
*H01R 29/00* (2006.01)

(52) U.S. Cl. ..... 439/188; 439/611

(58) Field of Classification Search ..... 439/188, 439/611, 688.2; 362/652
See application file for complete search history.

(56) References Cited

U.S. PATENT DOCUMENTS

| | | | | | |
|---|---|---|---|---|---|
| 932,129 | A | * | 8/1909 | Hughes | 16/298 |
| 1,536,332 | A | * | 5/1925 | Dam | 200/51.1 |
| 2,025,564 | A | * | 12/1935 | Blake | 200/51.11 |
| 2,576,363 | A | * | 11/1951 | Rimbach et al. | 315/122 |
| 3,359,523 | A | * | 12/1967 | Lou | 338/70 |
| 4,727,449 | A | * | 2/1988 | Fleck | 361/54 |
| 4,894,019 | A | * | 1/1990 | Howard | 439/188 |
| 4,991,071 | A | * | 2/1991 | Braasch | 362/249.14 |
| 5,071,362 | A | * | 12/1991 | Martens et al. | 439/188 |
| 5,139,343 | A | * | 8/1992 | Lin | 362/654 |
| 5,281,158 | A | * | 1/1994 | Lin | 439/188 |
| 5,453,664 | A | * | 9/1995 | Harris | 315/185 S |
| 5,455,484 | A | * | 10/1995 | Maya et al. | 315/58 |
| 5,702,262 | A | * | 12/1997 | Brown et al. | 439/188 |
| 5,994,845 | A | * | 11/1999 | Gibboney, Jr. | 315/185 S |
| 6,053,774 | A | * | 4/2000 | Lin | 439/619 |
| 6,157,139 | A | * | 12/2000 | Gibboney, Jr. | 315/185 S |
| 6,203,169 | B1 | * | 3/2001 | Coushaine et al. | 362/652 |
| 6,224,415 | B1 | * | 5/2001 | Gibboney, Jr. | 439/356 |
| 6,257,740 | B1 | * | 7/2001 | Gibboney, Jr. | 362/288 |
| 6,283,797 | B1 | * | 9/2001 | Wu | 439/699.2 |
| 6,533,437 | B1 | * | 3/2003 | Ahroni | 362/249.14 |
| 6,609,814 | B2 | * | 8/2003 | Ahroni | 362/249.12 |
| 6,650,065 | B1 | * | 11/2003 | Shieh | 315/185 R |
| 6,713,971 | B1 | * | 3/2004 | Wong | 315/185 S |
| 6,755,552 | B2 | * | 6/2004 | Lee | 362/647 |
| 6,765,313 | B2 | * | 7/2004 | Janning | 307/36 |
| 6,774,549 | B2 | * | 8/2004 | Tsai et al. | 313/318.01 |
| 6,805,463 | B2 | * | 10/2004 | Shieh | 362/653 |
| 6,806,656 | B2 | * | 10/2004 | Rahman | 315/185 R |
| 7,086,758 | B2 | * | 8/2006 | Janning | 362/249.14 |
| 7,178,961 | B2 | * | 2/2007 | Janning | 362/565 |

(Continued)

*Primary Examiner* — Khiem Nguyen
(74) *Attorney, Agent, or Firm* — Ryan A. Schneider, Esq.; Robert A. Madayag, Esq.; Troutman Sanders LLP

(57) ABSTRACT

A lamp system used in a light string system comprises a light assembly and a socket assembly. The light assembly comprises a light source, a base in communication with the light source, and a bypass activating system. The socket assembly comprises a socket adapted to receive the light assembly and a bypass mechanism having a first position and a second position. The bypass mechanism is in the first position when the light assembly is not seated in the socket assembly. When the bypass mechanism in the first position, current flows across the bypass mechanism. When the light assembly is inserted into the socket assembly, the bypass activating system of the light assembly moves the bypass mechanism into the second position, and current flows through the light source instead of the bypass mechanism.

12 Claims, 24 Drawing Sheets

U.S. PATENT DOCUMENTS

| | | | | |
|---|---|---|---|---|
| 7,186,017 | B2 * | 3/2007 | Kuo | 362/654 |
| 7,253,556 | B1 * | 8/2007 | Gibboney | 313/318.01 |
| 7,264,392 | B2 * | 9/2007 | Massabki et al. | 362/652 |
| 7,279,809 | B2 * | 10/2007 | Janning | 307/36 |
| 7,342,327 | B2 * | 3/2008 | Janning | 307/36 |
| 7,453,194 | B1 * | 11/2008 | Gibboney | 313/318.1 |
| 7,473,024 | B2 * | 1/2009 | Gibboney | 362/654 |
| 7,484,995 | B2 * | 2/2009 | Ding | 439/513 |
| 7,554,266 | B1 * | 6/2009 | Chen | 313/580 |
| 7,557,497 | B1 * | 7/2009 | Gibboney et al. | 313/318.1 |
| 7,581,870 | B2 * | 9/2009 | Massabki et al. | 362/654 |
| 2003/0142494 | A1 * | 7/2003 | Ahroni | 362/251 |
| 2003/0198044 | A1 * | 10/2003 | Lee | 362/226 |
| 2004/0105270 | A1 * | 6/2004 | Shieh | 362/378 |
| 2005/0041422 | A1 * | 2/2005 | Janning | 362/227 |
| 2005/0122723 | A1 * | 6/2005 | Frederick | 362/302 |
| 2005/0286267 | A1 * | 12/2005 | Wang | 362/653 |
| 2006/0146578 | A1 * | 7/2006 | Kuo | 362/654 |
| 2006/0274556 | A1 * | 12/2006 | Massabki et al. | 362/652 |
| 2007/0159109 | A1 * | 7/2007 | Gibboney | 315/185 S |
| 2007/0297196 | A1 * | 12/2007 | Massabki et al. | 362/655 |
| 2008/0024071 | A1 * | 1/2008 | Yu | 315/192 |
| 2008/0130284 | A1 * | 6/2008 | Altamura et al. | 362/251 |
| 2008/0186740 | A1 * | 8/2008 | Huang et al. | 362/652 |
| 2008/0239758 | A1 * | 10/2008 | Ng | 362/659 |
| 2008/0258630 | A1 * | 10/2008 | Collins et al. | 315/122 |
| 2008/0303446 | A1 * | 12/2008 | Ding | 315/185 R |
| 2009/0190359 | A1 * | 7/2009 | Li | 362/308 |
| 2009/0279325 | A1 * | 11/2009 | Massabki et al. | 362/654 |

* cited by examiner

LIGHT STRING SYSTEM

CROSS-REFERENCE TO RELATED APPLICATIONS

This application is a divisional and claims the benefit of U.S. patent application Ser. No. 12/582,538, filed 20 Oct. 2009, which claims the benefit under 35 U.S.C. §119(e), of U.S. Provisional Application Ser. No. 61/106,668, filed 20 Oct. 2008, the entire contents and substance of both hereby incorporated by reference.

BACKGROUND

Embodiments of the present invention relate to a lamp system used in a light string system and, more particularly, to a socket assembly adapted to receive a light assembly, wherein the lamp system is designed such that a remainder of the lights in the light string system remain lit even when one or more individual light assemblies are broken or missing from associated socket assemblies.

Light strings are known in the art. For instance, light strings are predominantly used during the holiday season for decorative purposes, e.g., Christmas tree lights, outdoor holiday lights, and icicles light sets.

Conventional light strings typically are arranged with lights on the strings being electrically connected in series, rather than in a parallel arrangement. Unfortunately, there are disadvantages to designing a light string in series. When even a single light bulb is removed from a socket, or broken, the entire series of lights is rendered inoperable. Because each light bulb within its respective socket completes the electrical circuit, when a light bulb is removed or the filament of the bulb burns out, a gap is created in the circuit, i.e., an open circuit is formed. Therefore, electricity is unable to flow through the circuit beyond the open socket. When a "good" or operable light bulb is inserted into the socket, the light bulb completes the circuit and allows electricity to flow uninterrupted through the light string.

U.S. Pat. No. 6,533,437 to Ahroni and U.S. Pat. No. 5,702,262 to Brown et al. are two examples of attempts to overcome these issues with convention light strings. Yet, Ahroni does not disclose that insertion of a light assembly into a socket assembly forces a bypass mechanism together, and Brown discloses a "dual signal" connector configured to provide for the passage of a signal through either one of two connectors in the assembly or through a circuit including both of the connectors in the assembly.

SUMMARY

Embodiments of the present invention relate to a lamp system for use in a light string system, the lamp system comprising a light assembly and a socket assembly. The light assembly comprises a light source, a base in communication with the light source, and a bypass activating system. The socket assembly comprises a socket adapted to receive the light assembly, first and second contacting members, and a bypass mechanism having a first position and a second position.

When the bypass mechanism is in the first position, current flows from the first contacting member, through the bypass mechanism, and to the second contacting member. When the light assembly is inserted into the socket assembly, the bypass mechanism moves into its second position. In the second position, current does not flow through the bypass mechanism, but current can flow through the lamp system by passing through the light source of the light assembly.

The bypass activating system of the light assembly is adapted to move the bypass mechanism of the socket assembly between the first and second positions. The bypass mechanism can comprise a cabinet and at least a first extending member.

The cabinet can have opposing first and second sides, where the first side faces the first contacting member. The first extending member can be attached to the cabinet at a joint, such that the first extending member is moveable while the cabinet remains substantially stationary relative to the socket. The first extending member can extend outwardly from the first side of the cabinet and be configured to extend to the first contacting member of the socket assembly when the bypass mechanism is in the first position.

The bypass activating system can comprise a separating member configured to interact with the first extending member. When the light assembly is inserted into the socket assembly, the separating member separates the first extending member of the bypass mechanism from the first contacting member of the socket assembly, thereby placing the bypass mechanism in the second position. When the light assembly is removed from the socket assembly, the first extending member resumes its contact with the first contacting member, thereby placing the bypass mechanism back into the first position.

In an exemplary embodiment, a bypass system for a lamp system can comprise a housing having a lower closed end, and opposing first and second peripheral walls extending upwardly from the lower closed end, the housing defining an opening to a cavity inside the housing, a cap securable to the housing over the opening, a first conductive member extending from inside the housing through the first peripheral wall of the housing, a second conductive member extending from inside the housing through the second peripheral wall of the housing, the first conductive member and the second conductive member being separated by a predetermined distance within the cavity of the housing, a bypass mechanism inside the cavity of the housing and having a first position and a second position, wherein in the first position, the bypass mechanism contacts both the first and second conductive members and is configured to carry current between the first conductive member and the second conductive member, and wherein in the second position, the bypass mechanism does not contact the first conductive member, a compressible biasing member for supporting the bypass mechanism within the cavity of the housing, and an actuator in communication with the bypass mechanism and extending from inside the cavity of the housing through the cap, when the cap is secured over the housing, the actuator being configured to push the bypass mechanism downwardly into the compressible biasing member, thereby causing the compressible biasing member to compress and displacing the bypass mechanism from the first conductive member, thereby placing the bypass mechanism in the second position, and wherein the bypass system is configured for integral insertion into a socket of a lamp system.

In another exemplary embodiment, a bypass system for a lamp system can comprise a housing having a lower closed end, and opposing first and second peripheral walls extending upwardly from the lower closed end, the housing defining an opening to a cavity inside the housing, a cap securable to the housing over the opening, a first conductive member extending from inside the housing through the first peripheral wall of the housing, a second conductive member extending from inside the housing through the second peripheral wall of the housing, the first conductive member and the second conductive member being separated by a predetermined distance within the cavity of the housing, a bypass mechanism inside the cavity of the housing and having a first position and a second position, wherein in the first position, the bypass mechanism contacts both the first and second conductive members and is configured to carry current between the first conductive member and the second conductive member, and wherein in the second position, the bypass mechanism does not contact the first conductive member, a compressible biasing member for supporting the bypass mechanism within the cavity of the housing, and wherein the bypass system is configured for integral insertion into a socket of a lamp system.

The bypass system can further comprise an actuator in communication with the bypass mechanism and extending from the cap into the cavity of the housing when the cap is secured to the housing over the opening.

The actuator can push the bypass mechanism downwardly into the compressible biasing member to compress and displace the bypass mechanism from the first conductive member, thereby placing the bypass mechanism in the second position.

The compressible biasing member can be selected from the group consisting of a spring, a topped spring, a sheathed spring, a zig-zag spring, a coiled spring, and a hinge.

The compressible biasing member can be conductive.

The first conductive member or the second conductive member can be flexible at a flexible point so that the first conductive member or the second conductive member flex when in contact with the first contacting member or the second contacting member. The flexible point can be a hinge.

The cavity can be adapted to house and protect the compressible biasing member and the bypass mechanism.

These and other objects, features, and advantages of the present invention will become more apparent upon reading the following specification in conjunction with the accompanying drawings.

DETAILED DESCRIPTION

Figure 1:
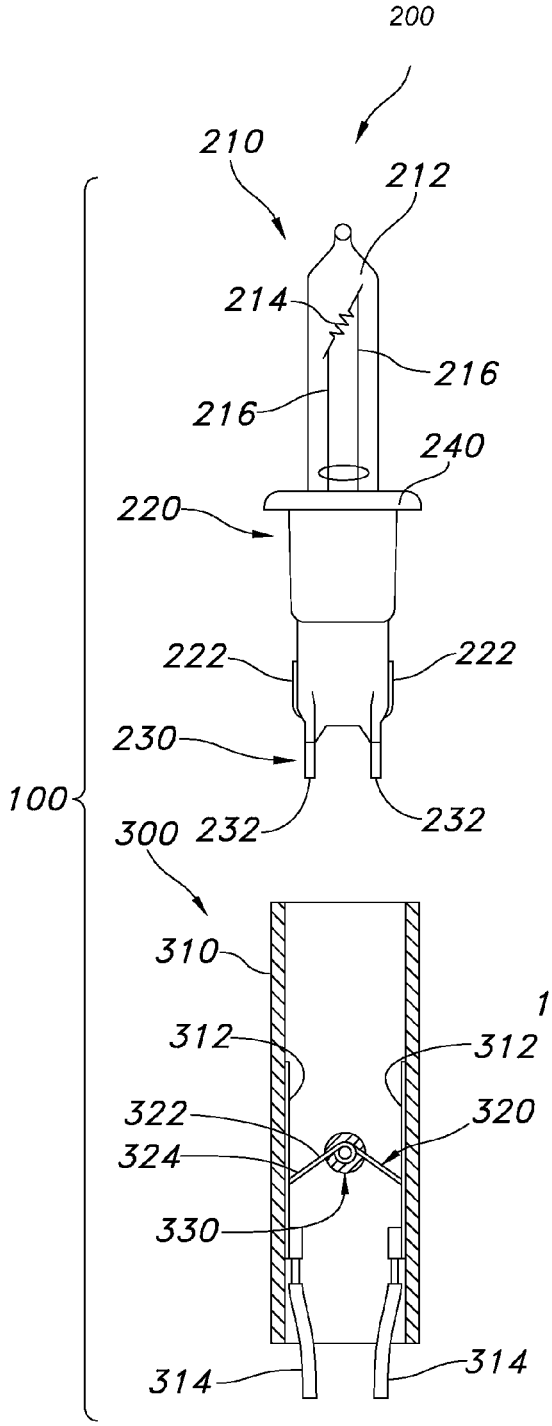
FIG. 1 illustrates a cross sectional view of a lamp system for use in a light string system.

To facilitate an understanding of the principles and features of the invention, embodiments are explained hereinafter with reference to implementation in an illustrative embodiment. In particular, embodiments of the invention are described in the context of being a bypass system for a lamp system of a light string system.

Embodiments of the invention, however, are not limited to use as a bypass system for a lamp system. Rather, embodiments of the invention can be used as a circuit or other system with a mechanical shunt device is needed or desired. For example, although embodiments of the present invention are described as controlling flow through a light assembly when seated/unseated from a socket assembly, it will be understood that the disclosed socket assembly can be used with other insertable assemblies to shunt electrical flow through the insertable assembly.

It must also be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named.

Also, in describing the exemplary embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

Similarly, as used herein, "substantially free" of something, or "substantially pure", and like characterizations, can include both being "at least substantially free" of something, or "at least substantially pure", and being "completely free" of something, or "completely pure".

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

The materials described as making up the various elements of the invention are intended to be illustrative and not restrictive. Many suitable materials that would perform the same or a similar function as the materials described herein are intended to be embraced within the scope of the invention. Such other materials not described herein can include, but are not limited to, for example, materials that are developed after the time of the development of the invention.

Referring now in detail to the figures, FIGS. 1-20 were previously disclosed in U.S. patent application Ser. No. 11/849,423, filed 4 Sep. 2007, now U.S. Pat. No. 7,581,870, which is herein incorporated by reference as if fully set out below. FIGS. 1-20 illustrate various components of a lamp system, and those components may clarify certain aspects of embodiments of the present invention. For clarity, FIGS. 1-20 and their descriptions are provided below.

FIG. 1 is a partial cross-sectional view of a first lamp system for use in a light string system. A typical light string system comprises a plurality of lamp systems 100 connected in series, wherein each lamp system 100 has a light assembly 200 and a socket assembly 300. The light assembly 200 can comprise a light source 210, a base 220 in communication with the light source 210, and a bypass activating system 230. The socket assembly 300 can comprise a socket 310 adapted to receive the light assembly, 200 and a bypass mechanism 320 having a first position and a second position.

The light assembly 200 includes the light source 210, which provides light when energized. The light source 210 can be many types of light sources, including a light bulb, light emitting diode (LED), incandescent lamp, halogen lamp, fluorescent lamp, or the like. For example, the light source 210 can be a light bulb, as shown in FIG. 1. The light assembly 200 and, more typically, the light bulb 210 of the light assembly 200 has a shunt device (not shown) to keep the light string system illuminated, even if the bulb 210 burns out.

The light source 210 can include a globe 212 and a filament 214. The globe 212 is in communication with, and terminates at, the base 220. The globe 212 can be made of conventional translucent or transparent material such as plastic, glass, and the like. Typically, the globe 212 includes a hollow interior enabling protection of the filament 214.

When charged with energy, the filament 214 illuminates the light source 210. Conductors 216 can be in electrical communication with the filament 214. The conductors 216 enable energy into the light source 210 to illuminate the filament 214 and, as a result, the light source 210. The conductors 216 extend down through the base 220, wherein the conductors 216 can be in communication with a pair of lead wires 222 external the base 220. The lead wires 222 can be a pair of wires extending through a bottom of the base 220. A portion of the lead wires 222 that extends through the base can wrap around the base 220, for example, further extending upwardly in the direction of globe 212 adjacent the base 220.

The light assembly 200 further includes the base 220, which can be integrally formed with the light source 210 or a separate element from the light source 210. The base 220 communicates between the light source 210 and an associated socket 310, complimenting and facilitating the seating of the light assembly 200 into the socket 310. The base 220 can incorporate a least one ridge 226 (see FIG. 4) to ensure a snug fit with the socket 310, preventing accidental disengagement of the light assembly 200 from the socket assembly 300. Other mechanical means can be used with the base 220 and the socket assembly 300 to ensure a tight fit.

Figure 4:
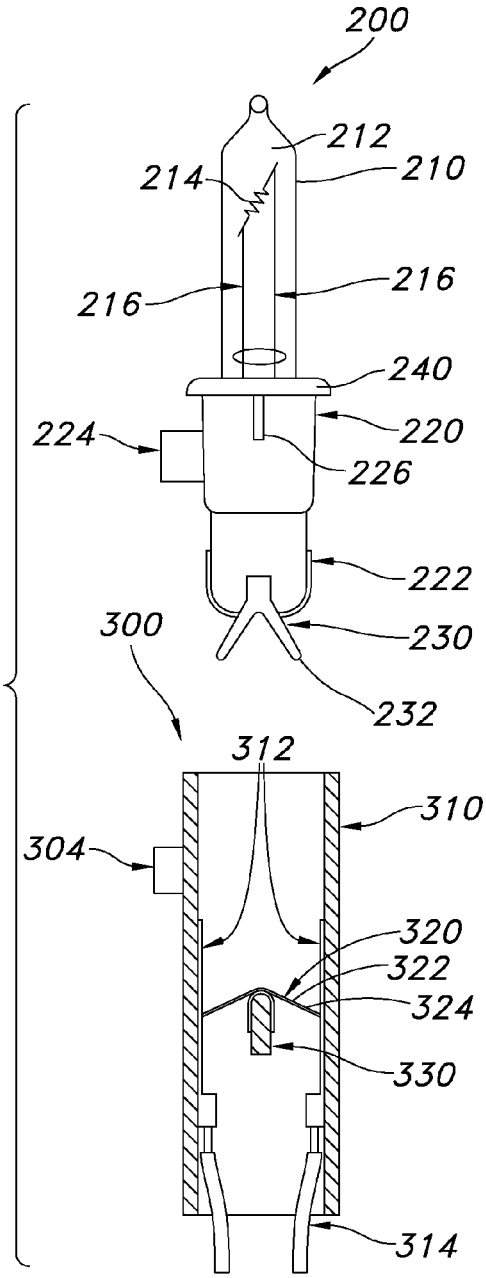
FIG. 4 illustrates a cross sectional view of another lamp system for use in a light string system.

For example, the light assembly 200 can also include a locking assembly to secure the light assembly 200 to the socket assembly 300. The locking assembly can be exterior or designed within the socket assembly 300 to fasten the connection of the light assembly 200 to the socket assembly 300 internally. As shown in FIG. 4, the locking assembly can be external and can include cooperating light assembly elements 224 and socket assembly element 304. These elements 224 and 304 can be formed as a clasp and a lock to insert the clasp. For example, the base 220 of the light assembly 200 can include the element 224 that extends normal to the base 220 and can define an aperture. On the other end of the locking assembly can be the element 304 of the socket 310 to be inserted into the element 224 of the base 220. As the element 304 of the socket 310 is inserted into the element 224 of the base 220, the locking assembly locks the light assembly 200 to the socket assembly 300. Stringent Underwriters Laboratories (UL) requirements may require that lights and sockets fit tightly together, which may decrease the value of a locking mechanism in the lamp system 100. The improvement in injection molding machines now enables the production of sockets and lamp assemblies that have a tight, snug fit.

The bypass activating system 230 of the light assembly 200 can activate and deactivate the bypass mechanism 320 of the socket assembly 300 by moving the bypass mechanism 320 between the first and second positions. The bypass activating system 230 can extend in a downward direction from base 220 of the light assembly 200 to activate the bypass mechanism 320 of the socket assembly 300 upon the proper seating of the light assembly 200 in the socket assembly 300. In one embodiment of the present invention, the bypass activating system 230 can be in a downward "V" shape (see FIG. 4). Alternatively, the bypass activating system 230 can be one or more extending members 232 (see FIG. 1), or can comprise various other configurations complementary to the configuration of the bypass mechanism 320.

The socket assembly 300 comprises the socket 310 adapted to receive the light assembly 200. The socket 310 defines a cooperatively-shaped aperture to receive the base 220 of the light assembly 200. The socket 310 can also be adapted to receive the whole of the bypass activating system 230 of the light assembly 200. The socket 310 can be arranged in many shapes and sizes, but the socket 310 should be of a shape to conveniently receive the light assembly 200.

The socket 310 can include a pair of socket terminals 312. The socket terminals 312 can be located on opposing inner sides of the socket 310. The socket 310 further includes a pair of terminal wires 314 extending to the exterior to allow energy to enter and exit the socket 310. Each socket terminal 312 can be essentially an extension of each respective terminal wire 314. The terminal wire 314 extends through the bottom of the socket 310 to ultimately connect to an electrical source. Therefore, the electrical current is introduced into the socket 310 by one of the terminal wires 314 and conducted either through the bypass mechanism 320, if the bypass mechanism 320 is in the first position, or through lead wires 222 to the filament 214 to illuminate the light bulb 210, if in the second position. Regardless of path, the current can flow to the other of the lamp systems 100 of the light string.

The bypass mechanism 320 of the socket assembly 300 includes a conductive element 322, which can sits on a fulcrum 330 in the socket 310. The conductive element 322 has a first position and a second position corresponding to the first and second positions of the bypass mechanism 320. The bypass mechanism 320 can be positioned on a centrally-positioned fulcrum of the socket assembly 300.

As shown in FIG. 1, the bypass mechanism 320 incorporates the conductive element 322, such that an electric circuit is provided from the left terminal wire 314, through the left socket terminal 312 across conductive element 322, and ultimately to the right terminal wire 314 via the right socket terminal 312.

In some instances, the conductive element 322 can be a spring mechanism 324. The socket 310 is dimensioned to receive the insertion of the bypass activating system 230, which can force the single spring 324 together, not apart, when the light assembly 200 is inserted into the socket 310. The single spring 324 springs apart, not together, when the light assembly 200 is removed from the light socket 310. The spring 324 sits about the fulcrum 330.

Figure 3:
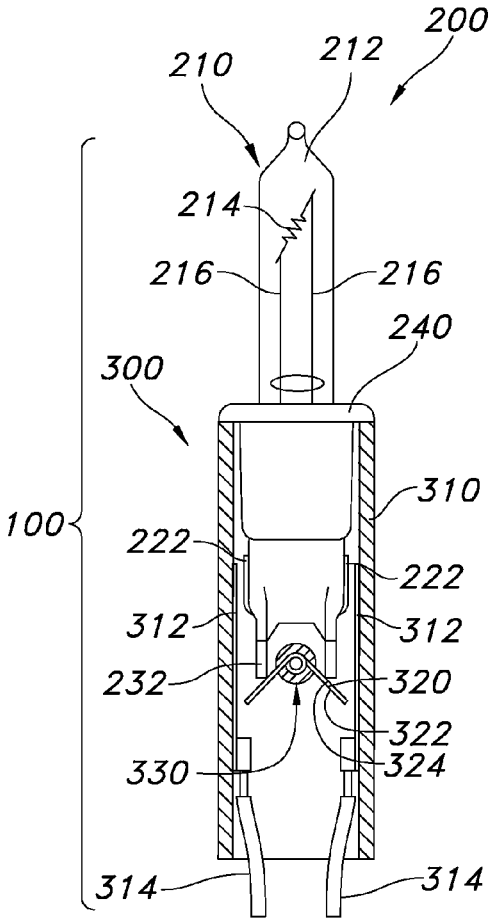
FIG. 3 illustrates a cross sectional view of the lamp system of FIG. 1 fully inserted.

When the light assembly 200 is inserted into the socket 310, the bypass activating system 230 pushes at least one side of the conductive element 322 down, distal the socket terminal 312 to "open" the circuit across 322. This disables the electrical connection that the bypass mechanism 320 created, and the circuit is closed via the bulb 210, as opposed to the conductive element 322. As shown in FIG. 3, both sides of the conductive element 322 are disengaged by the bypass activating system 230. The bypass mechanism 320 can be a centrally fulcrumed spring mechanism about the fulcrum 330, and the two extending members 232 push both sides of the conductive element 322 away from the socket terminals 312. Other bridging mechanisms can be used beyond fulcrum 330 to support the element 322 across the socket 310.

The bypass activating system 230 can have one or more pointed or rounded tips that facilitate disconnecting the bypass mechanism 320 from the socket terminals 312. The bypass activating system 230 disables the physical connection of the bypass mechanism 320, thereby eliminating any electrically conductive path for the electrical current to flow, other than through the inserted assembly 200.

The bypass mechanism 320 permits the removal of one or more light assemblies 200 of the lamp system 100, while maintaining the lighting of the remaining lights of a light string system. When a light assembly 200 is missing from a socket 310, the bypass mechanism 320 creates a short circuit, and therefore enables current flow to continue to other lamp systems 100 within a light string. Each socket 310 can have a single current carrying bypass mechanism 320, which pushes away from the socket terminal 312 when the bypass activating system 230 engages the bypass mechanism 320, thereby breaking electrical continuity across the bypass mechanism 320. When the base 220 of the light assembly 200 is fully engaged in the socket 310, the lead wires 222 extending from the base 220 will make electrical contact with the socket terminals 312 completing the electrical circuit. When the light assembly 200 is removed, the bypass mechanism 320 opens again and makes contact with the socket terminals 312, maintaining the electrical connection.

Figure 2:
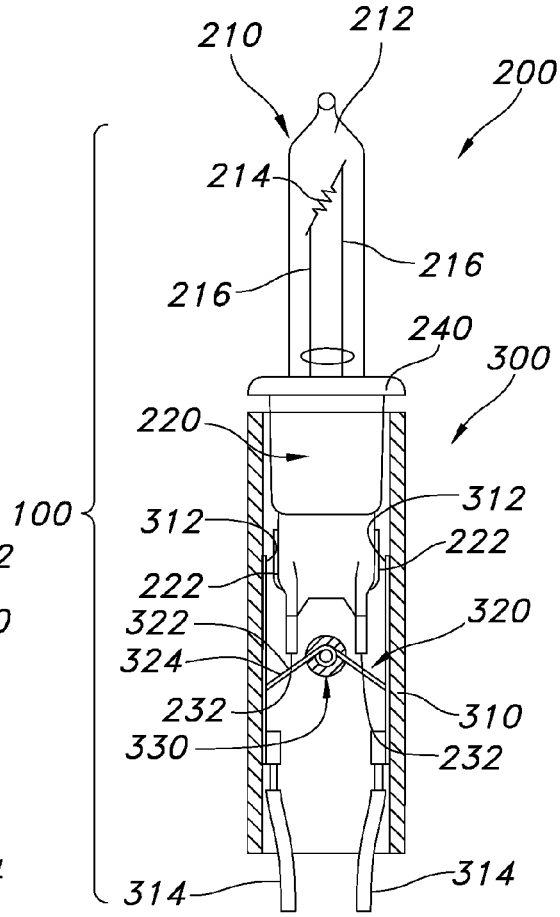
FIG. 2 illustrates a cross sectional view of the lamp system of FIG. 1 partially inserted.

The bypass mechanism 320 has a first position and a second position. The first position bypasses energy flow when a light assembly 200 is burnt out or not properly seated in the socket 310 (FIGS. 1-2). In the first position, the bypass mechanism 320 extends to make contact with the sides of the socket 310, the socket terminal 312. As a result, an electrical circuit is created, or a short circuit is formed. This situation arises when the light assembly 200 is missing from the socket 310. The second position enables energy to flow through the light source 210 to illuminate it (FIG. 3). In the second position, the bypass mechanism 320 is removed from electrical communication from at least one side of the socket 310 (at least one socket terminal 312). The electrical circuit through the bypass mechanism 320 is disconnected, or an open circuit is formed. This situation typically arises when a light assembly 200 is fully inserted into the socket 310. For instance, the bypass activating system 230 pushes the bypass mechanism 320 together when the light assembly 200 is being seated in the socket 310; and the bypass mechanism 320 pushes apart when the light source 210 is being removed from the socket 310.

FIGS. 1-3 illustrate partial cross sectional views of a lamp system 100, illustrating the light assembly 200 being inserted into and fully seated in the socket 310. As the light assembly 200 is inserted into the socket 310, electrical current flowing through the bypass mechanism 320 is interrupted. When physical contact between bypass mechanism 320 is broken by the bypass activating system 230, electrical current flow is then enabled to flow through the lead wires 222 and up through the conductors 216 to illuminate the light source 210. The current then resumes flowing out through the opposite side of the conductor 216 and down through the other lead wire 222, passing through the other terminal wire 314 until it exits that particular lamp system 100. A flange 240 engages the socket 310 when light assembly 200 is fully seated.

FIG. 4 illustrates another embodiment of a lamp system 100. The lamp system 100 includes the bypass activating system 230 shown having an upside down "V" shape. The shape of the bypass activating system 230 enables contact with the bypass mechanism 320, and further permits the switching of the bypass mechanism 320 from the first position to the second position. Additionally, in FIG. 4, the bypass mechanism 320 is positioned upon the fulcrum 330.

Figure 5A:
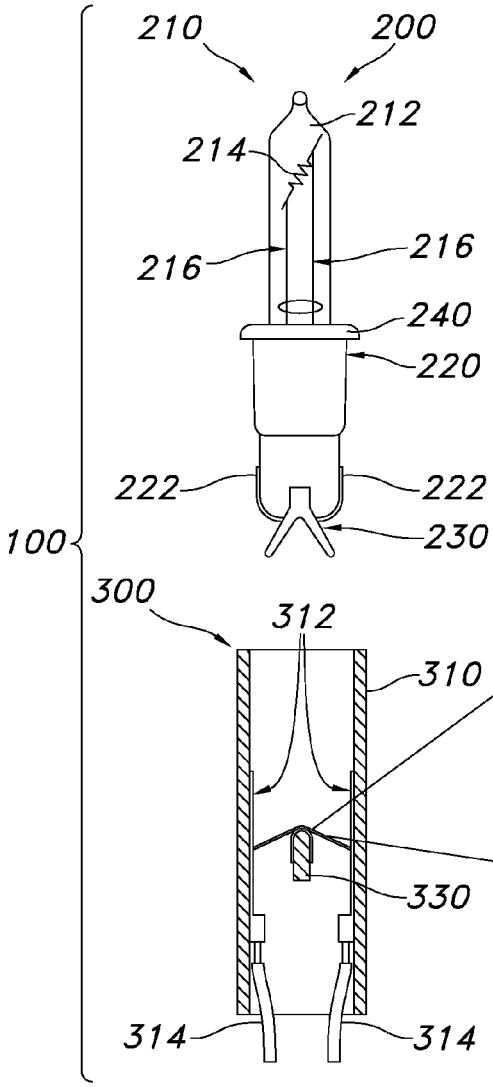
FIGS. 5A and 5B illustrate cross sectional views of the lamp system of FIG. 4 further illustrating the detail of a bypass mechanism.
Figure 5B:
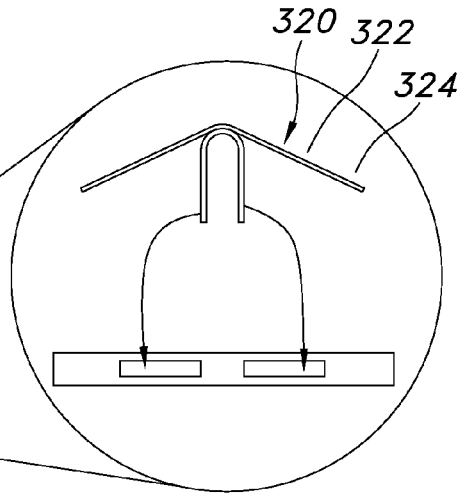

FIGS. 5A and 5B depict a cross sectional view of a lamp for use in a lamp system 100, further illustrating the detail of the bypass mechanism 320. The bypass mechanism 320 can be, for example, a spring 324. The spring 324 can be a single spring that is connected to the socket 310 with a fulcrum 330 in the socket 310. Providing a socket 310 with a centrally located, single fulcrum 330 enables easy manufacturability. The way the spring 324 is seated in the socket 310 can be by a pivot, hinge, pin, and the like, and need not be centrally located nor must the element 322 be a single element. The element 322 can include two or more elements that can be electrically communicative through the fulcrum 330. (This is used in the embodiment in FIGS. 9-11, wherein the contacting member 342 is shown as two distinct members, electrically communicative one end to the other when the top of the biasing member 344 completes the path.)

The spring 324 can be of a length to span the diameter of the socket 310. In this arrangement, the spring 324 would create the short circuit by contacting the socket terminals 312. In alternative embodiments, the spring 324 can be in connection with a conductor (not shown) to span the diameter of the socket 310.

Figure 6:
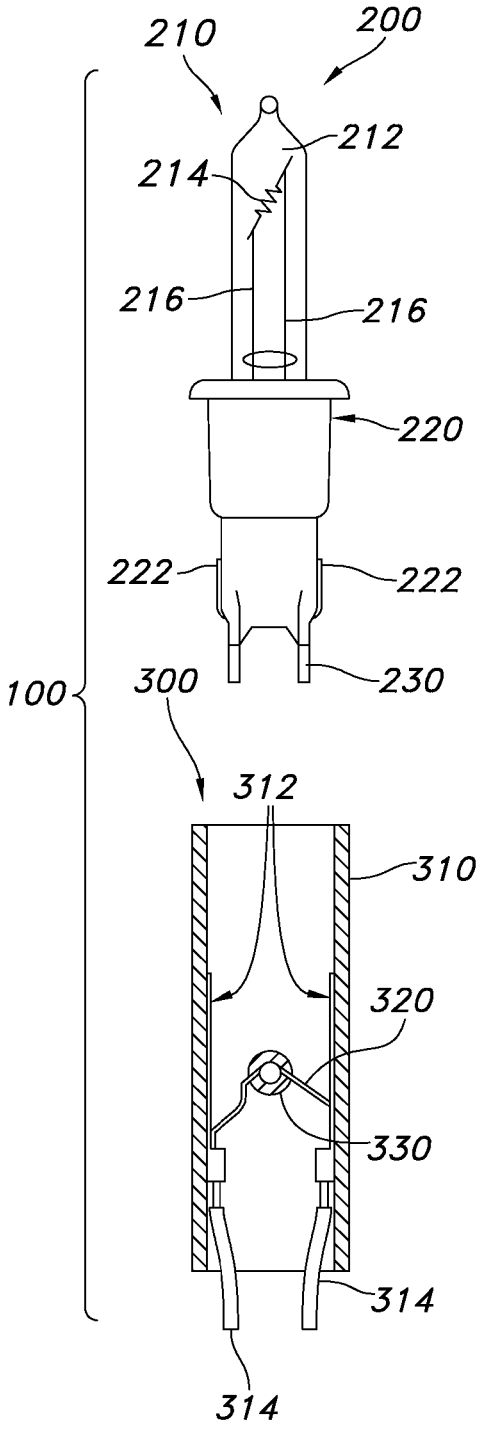
FIGS. 6-8 illustrate cross sectional views of yet another lamp system for use in a light string system, moving from non-insertion through full insertion.
Figure 7:
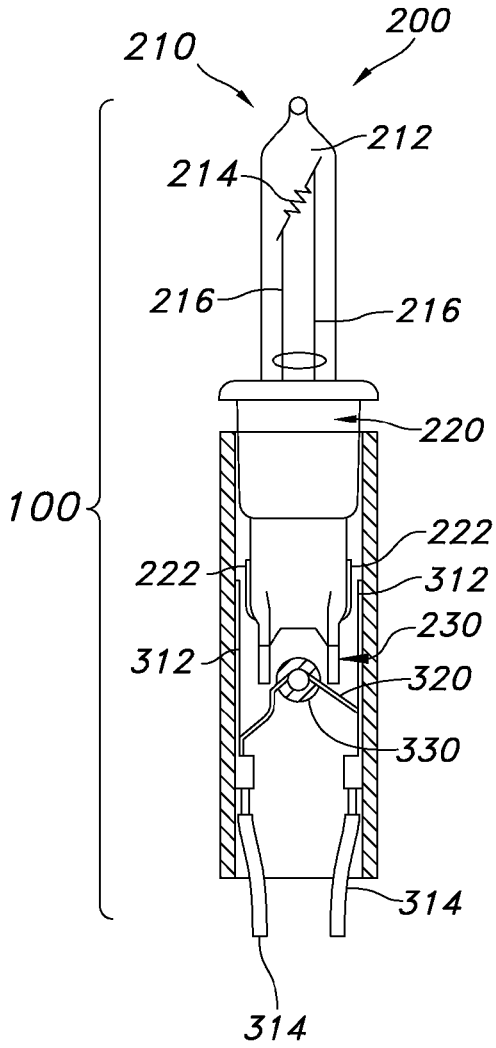
Figure 8:
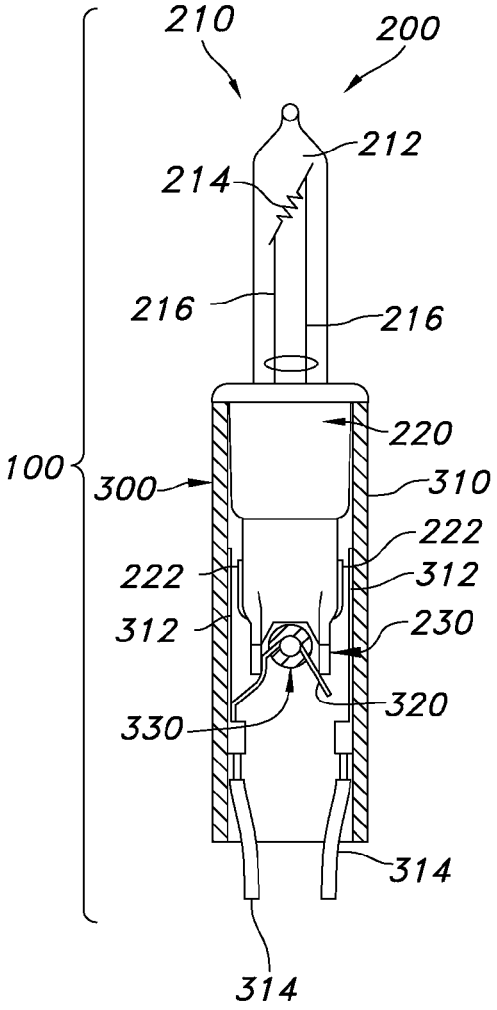

FIGS. 6-8 illustrate another lamp system for use in a light string. In FIGS. 6-8 the bypass activating system 230 strikes only one branch of the bypass mechanism 320. In this arrangement, the bypass mechanism 320 creates an open circuit by having the bypass activating system 230 strike only one side of the bypass mechanism 320. The bypass activating system 230, as depicted, includes two structures extending from the base 220 of the light assembly 200. Consequently, the bypass activating system 230 can include a single separating member 235 extending from the base 220. The bypass mechanism 320 still includes a first position and a second position.

In this embodiment, the left side terminal 314 is always in electrical communication with the bypass mechanism 320, and only the right side of the bypass mechanism 320 is activated between the first and second positions by the bypass activating system 230.

Figure 9:
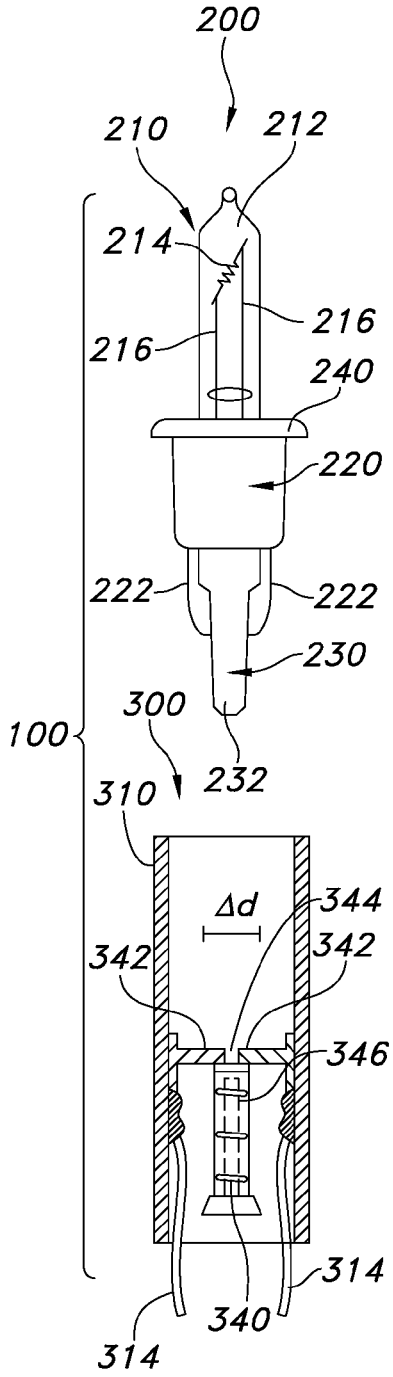
FIGS. 9-11 illustrate cross sectional views of yet another lamp system for use in a light string system.
Figure 10:
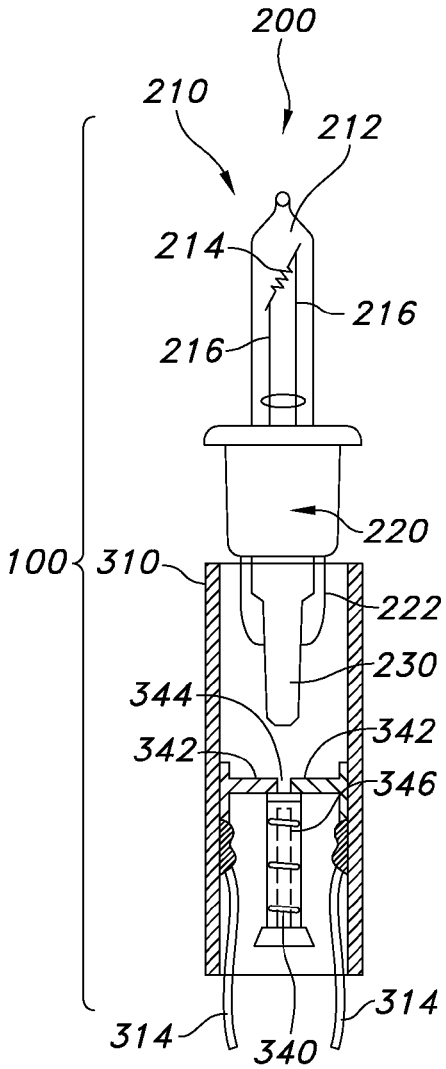
Figure 11:
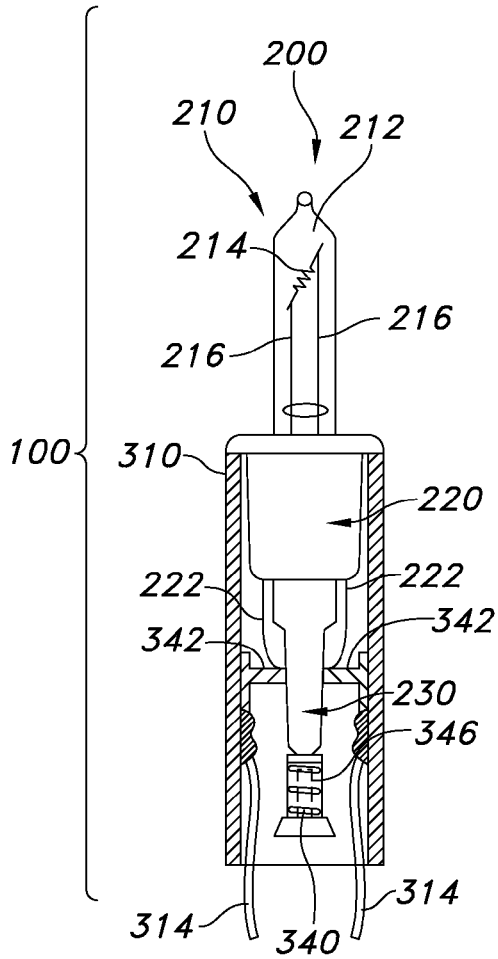

FIGS. 9-11 illustrate another lamp system. In FIGS. 9-11 the bypass activating system 230 strikes a bypass mechanism 340 as a light assembly 200 is inserted into a socket 310. Here, the bypass mechanism is a biasing member 344, of which at least the top portion is conductive. The biasing member can be, for example, a spring 346 or a topped or a sheathed spring 346, should the spring 346 not be conductive. At least the top or the sheath of the spring 346 can have a conductive layer to contact the contacting members 342, thereby providing an electrical path across the socket 310. The biasing member 344 can further be a zig-zag spring, a coiled spring, a hinge, and the like, wherein the top of the biasing member is electrically conductive.

The light assembly 200 is adapted to be inserted into the socket 310. The socket 310 can define an aperture or pocket sufficiently sized to receive the light assembly 200. At a predetermined depth of the socket 310, a pair of contacting members 342 is positioned. The contacting members 342 are made of conductive material, e.g., metal, copper, or the like. The contacting members 342 can extend inwardly from opposing sides of the socket 310. The contacting members 342 are separated by a predetermined distance (Δd) to permit receiving the bypass activating system 230.

Consequently, when the light assembly 200 is inserted into the socket 310, the bypass activating system 230 can contact the bypass mechanism 340. In addition, the lead wires 222, which are connected to the base 220 of the light assembly 200, contact the contacting members 342 enabling energy to flow through the light assembly 200. The bypass mechanism 340 has two positions, a first position and a second position. The first position bypasses energy flow when the light assembly 200 is not seated in the socket 310. The second position of the bypass mechanism 320 enables energy to flow through the light source 210, thereby illuminating the light source 210.

In this embodiment, the bypass mechanism 340 can be designed to move in and up and down motion, as the light assembly 200 is inserted into the socket 310, rather than pushed together and apart.

For instance, as illustrated in FIG. 9, which depicts the first position of the bypass mechanism 340, energy flows from the left terminal wire 314 to the left contacting member 342. The energy continues to flow through the conductive bypass mechanism 340, which acts like a shunt to connect the two contacting member 342. The energy then flows through the right contacting member 342 and out the right terminal wire 314. As the light assembly 200 is inserted into the socket, referring to FIGS. 10-11 wherein the bypass mechanism is placed in the second position, the bypass activating system 230 can push the bypass mechanism 320 away from the contacting members 342 to disable the shunt. Because at least a portion of the bypass activating system 230 is insulative, it prohibits energy to flow through the bypass mechanism 320 and, instead, allows illumination of the light source 210 of the light assembly 200.

Figure 12A:
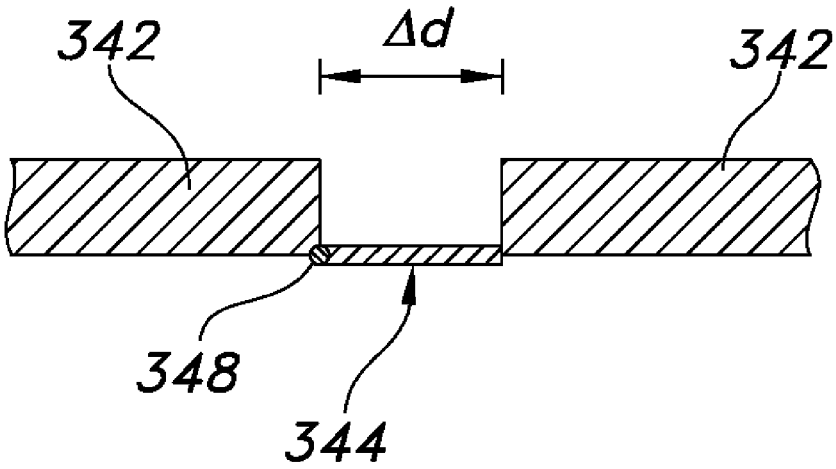
FIGS. 12A-12B illustrate a cross sectional close-up of a biasing member of the lamp system.
Figure 12B:
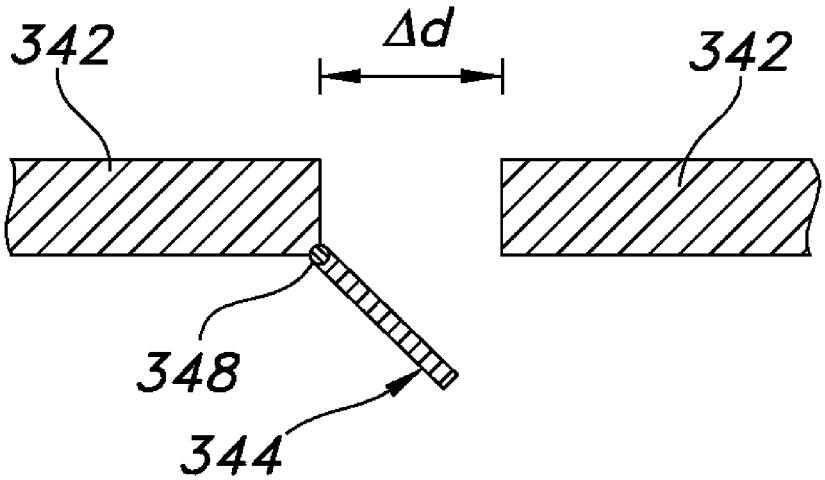

FIGS. 12A-12B depict the biasing member 344 in another lamp system. As opposed to being a spring element moveable up and down out of engagement with contacting members 342, the biasing member 344 can be removed from engagement only at only end. In this embodiment, the biasing member 344 is connected to one contacting member 342 by a hinge 348 or like device. The biasing member includes two positions—a first position and a second position. The first position, shown in FIG. 12A, exists when a light assembly 200 is absent from the socket assembly 300, and a coil spring or the like biases the member 344 to bring the gap (Δd). As a result the biasing member 344 makes contact with both contacting member 342 enabling a short circuit or shunt across the distance between the contacting members 342 (Δd). The second position, shown in FIG. 12B, of the biasing member 344 exists when the light assembly is inserted into the socket assembly, wherein the biasing member 344 is disabled from the short circuit to an open circuit.

Figure 13:
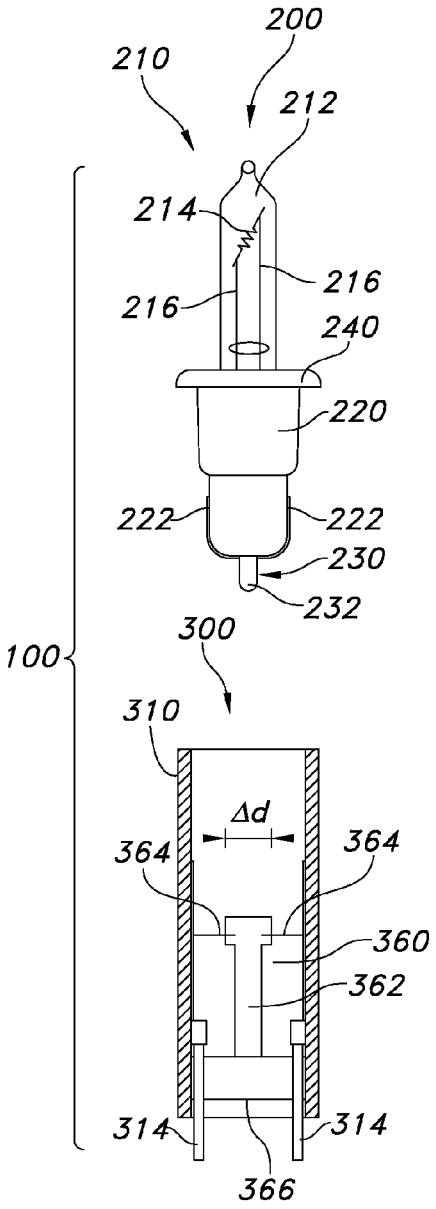
FIGS. 13-15 illustrate cross sectional views of yet another lamp system for use in a light string system.
Figure 14:
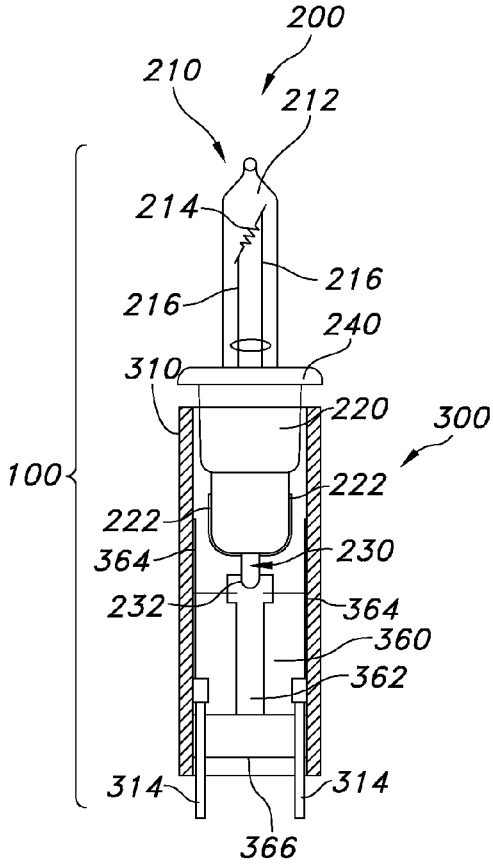
Figure 15:
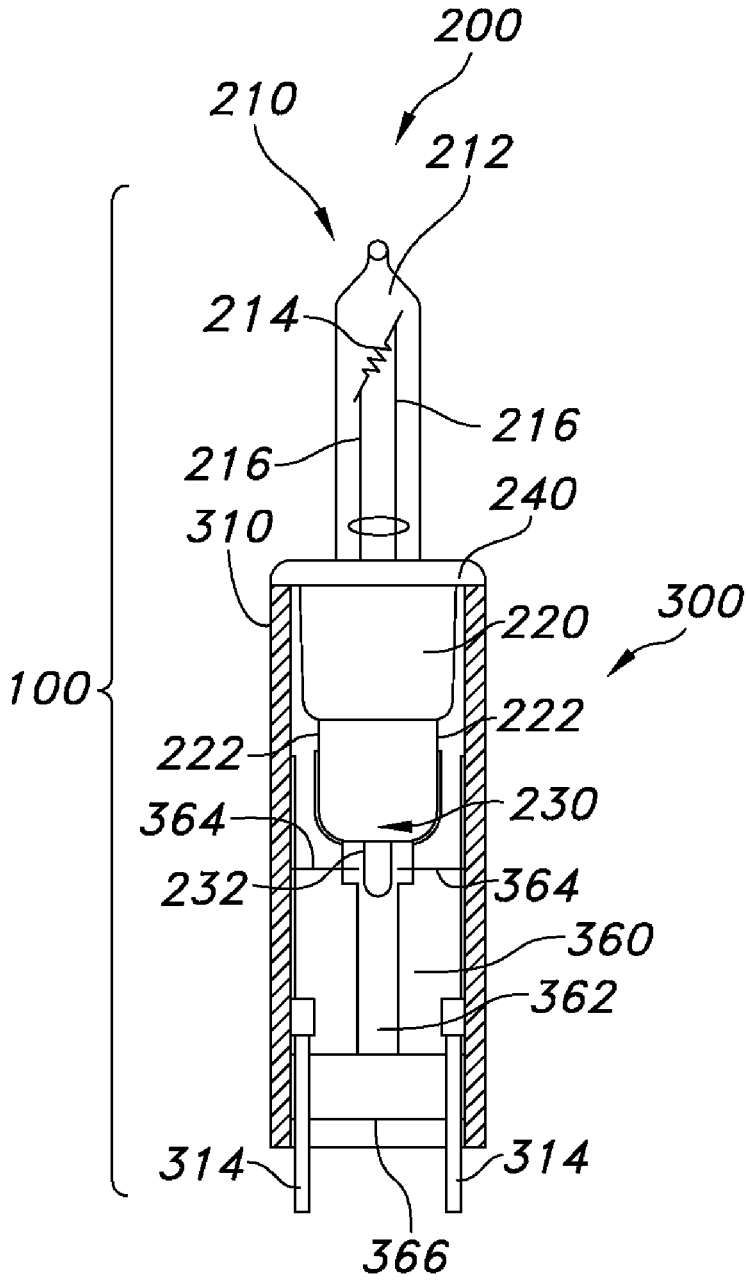

FIGS. 13-15 illustrate yet another lamp system. In FIGS. 13-15 the bypass activating system 230 strikes a bypass mechanism 360 as a light assembly 200 is inserted into the socket 310. In this embodiment, the bypass mechanism 360 is a moveable contact 362, which at least the top portion of which is conductive. The moveable contact 362 can be an electric conductor material having a spring-like property. The moveable contact 362 is adapted to be a bridging or shorting mechanism across a pair of contacting members 364. When the base 220 of the light assembly 200 is inserted into the socket 310, the bypass activating system 230 can push against the top of the moveable contact 362, wherein disabling the bridge or short across the contacting members 364.

The light assembly 200 is adapted to be inserted into the socket 310. The socket 310 defines an aperture sufficiently sized to receive the light assembly 200. At a predetermined depth of the socket 310, a pair of contacting members 364 is positioned. The contacting members 364 are made of conducting material, e.g., metal, copper, and the like. The contacting members 364 extend inwardly from opposite sides of the socket 310. The contacting members 364 are separated by a distance (Δd) enabling the bypass activating system 230 to fit therebetween.

As the light assembly 200 is inserted into the socket 310, the bypass activating system 230 can make contact with the bypass mechanism 360. The lead wires 222, extending from the base 220 of the light assembly 200, can contact the contacting members 364, wherein energy can flow through the light assembly 200.

Figure 16:
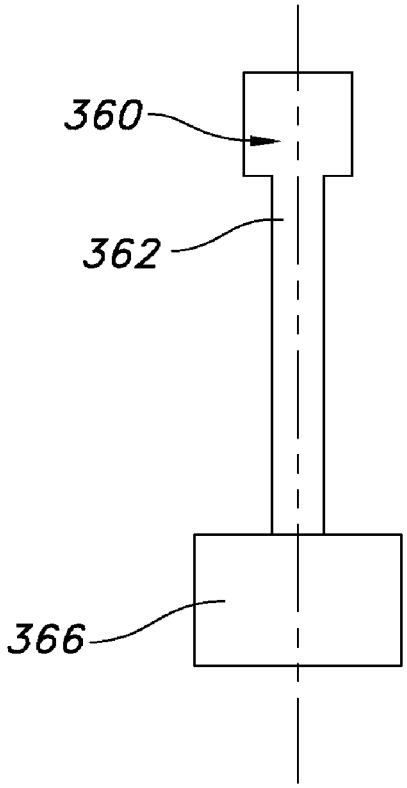
FIG. 16 illustrates a close-up view of a moveable contact of the lamp system.
Figure 17:
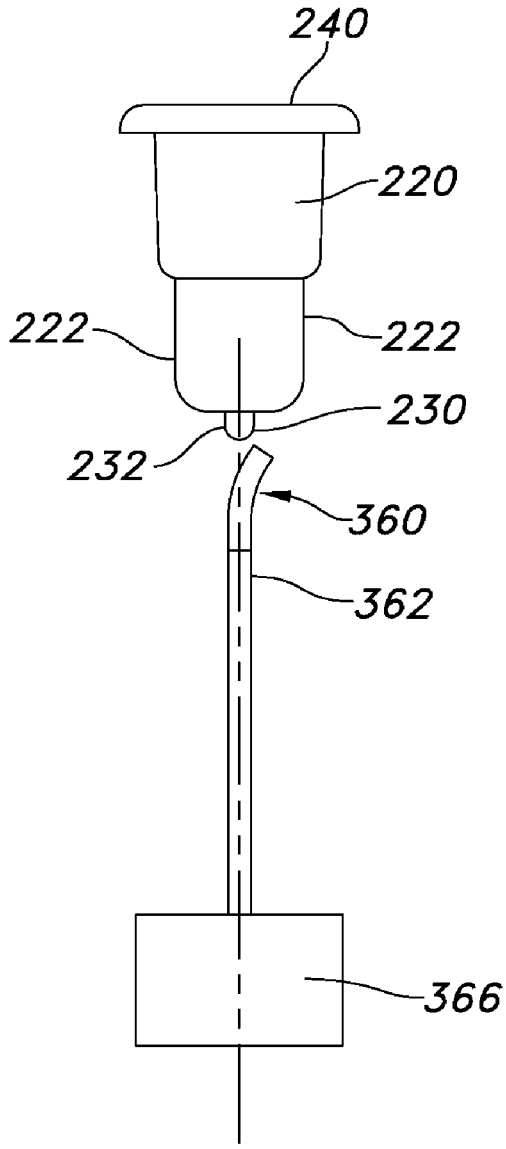
FIG. 17 illustrates a side, close-up view of the moveable contact illustrating the movement of the movable contact.

The bypass mechanism 360 includes two positions—a first position and a second position. These positions are illustrated in FIGS. 16-17. The first position, depicted in FIG. 16, bypasses energy when the light assembly 200 is not seated in the socket 310. The second position of the bypass mechanism 360, depicted in FIG. 17 enables energy to flow through the light source 210, thereby enabling illumination of the light source 210.

The bypass mechanism 360, which can be the moveable contact 362, is in communication with a stopper 366. The stopper 366 can be made of plastic, polymers, and the like. The stopper 366 provides the stability to the bypass mechanism 360 necessary to enable the moveable contact 362 be able to flex.

In this embodiment, the bypass mechanism 360 can be designed to move lateral to the longitudinal shape of the socket 310. Accordingly, instead of moving in an up and down direction (as previously described), the bypass mechanism 360 moves side to side. The bypass mechanism 360 moves away from contacting members 364 and moves towards the inner wall of the socket 310. As illustrated in FIGS. 14-15, the bypass activating system 230 is depicted in front of the bypass mechanism 360, because the separating member 235 pushes the bypass mechanism 360 away from the contacting members 364. This is depicted from a side view in FIG. 17.

For instance, as illustrated in FIG. 13, which depicts the first position of the bypass mechanism 360, energy flows from the left terminal wire 314 to the left contacting member 364. The energy continues to flow through the conductive bypass mechanism 360, which acts like a shunt to connect the two contacting member 342. The energy then flows through the right contacting member 364 and out the right terminal wire 314. As the light assembly 200 is inserted into the socket, referring to FIGS. 14-15 wherein the bypass mechanism is placed in the second position, the bypass activating system 230 can push the bypass mechanism 360 away from the contacting members 364 to disable the shunt. Because at least a portion of the bypass activating system 230 is insulative, it prohibits energy to flow through the bypass mechanism 360 and, instead, allows illumination of the light source 210 of the light assembly 200.

Figure 18:
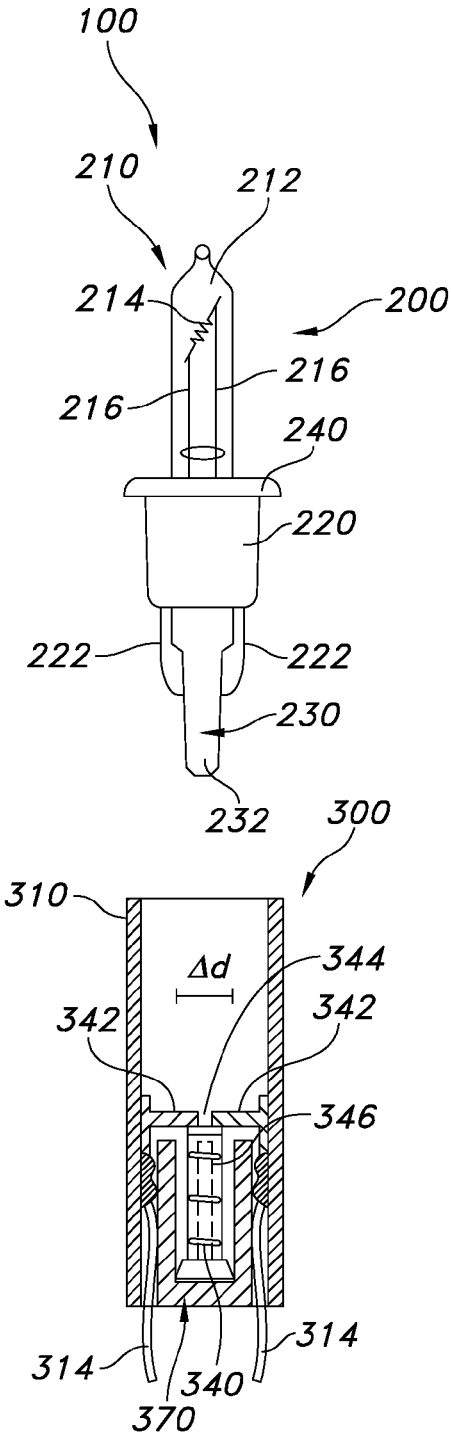
FIGS. 18-20 illustrate cross sectional views of yet another lamp system for use in a light string system.
Figure 19:
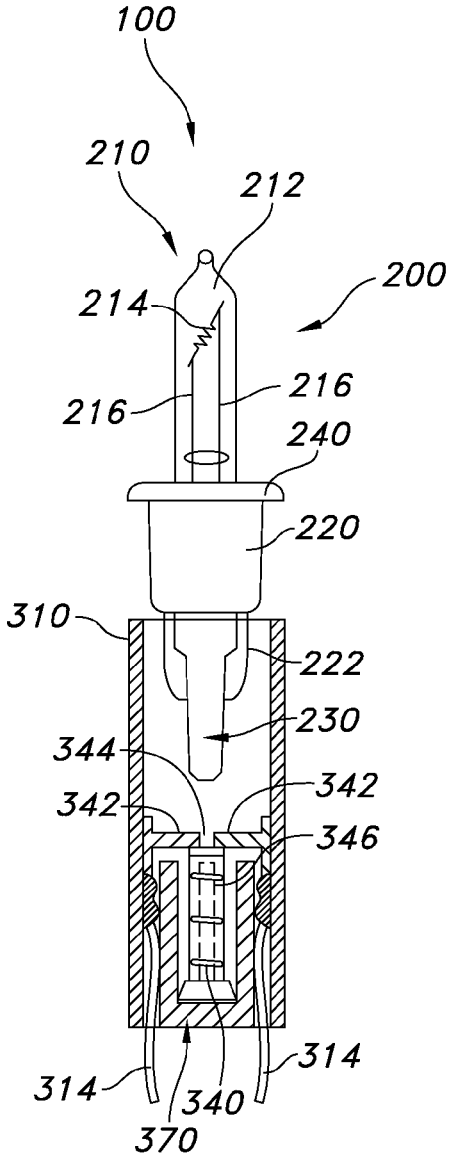
Figure 20:
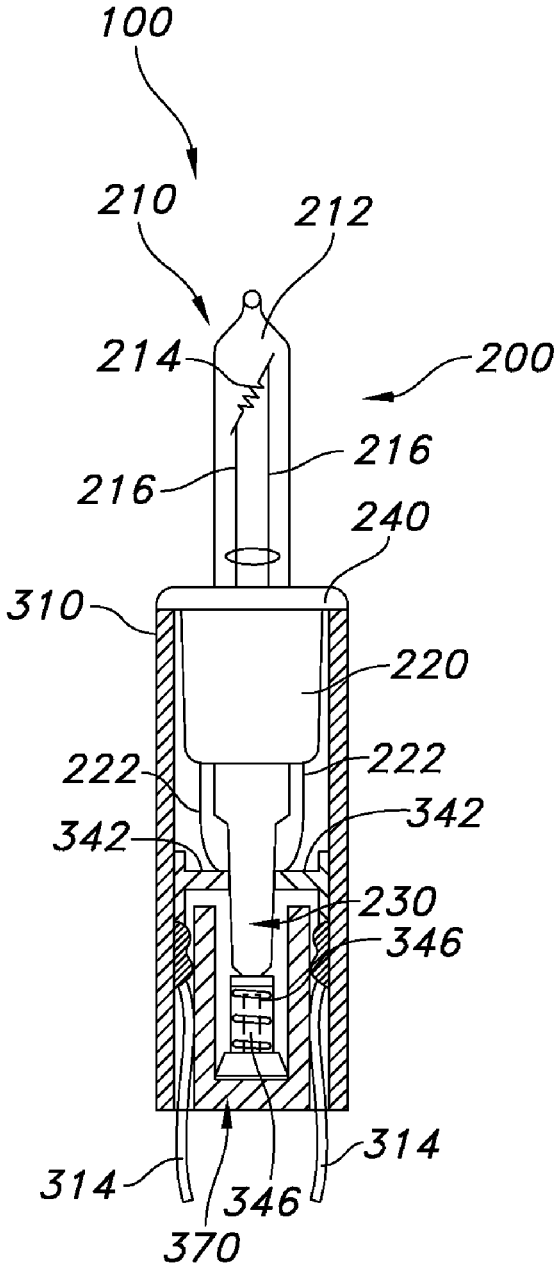
Figure 21:
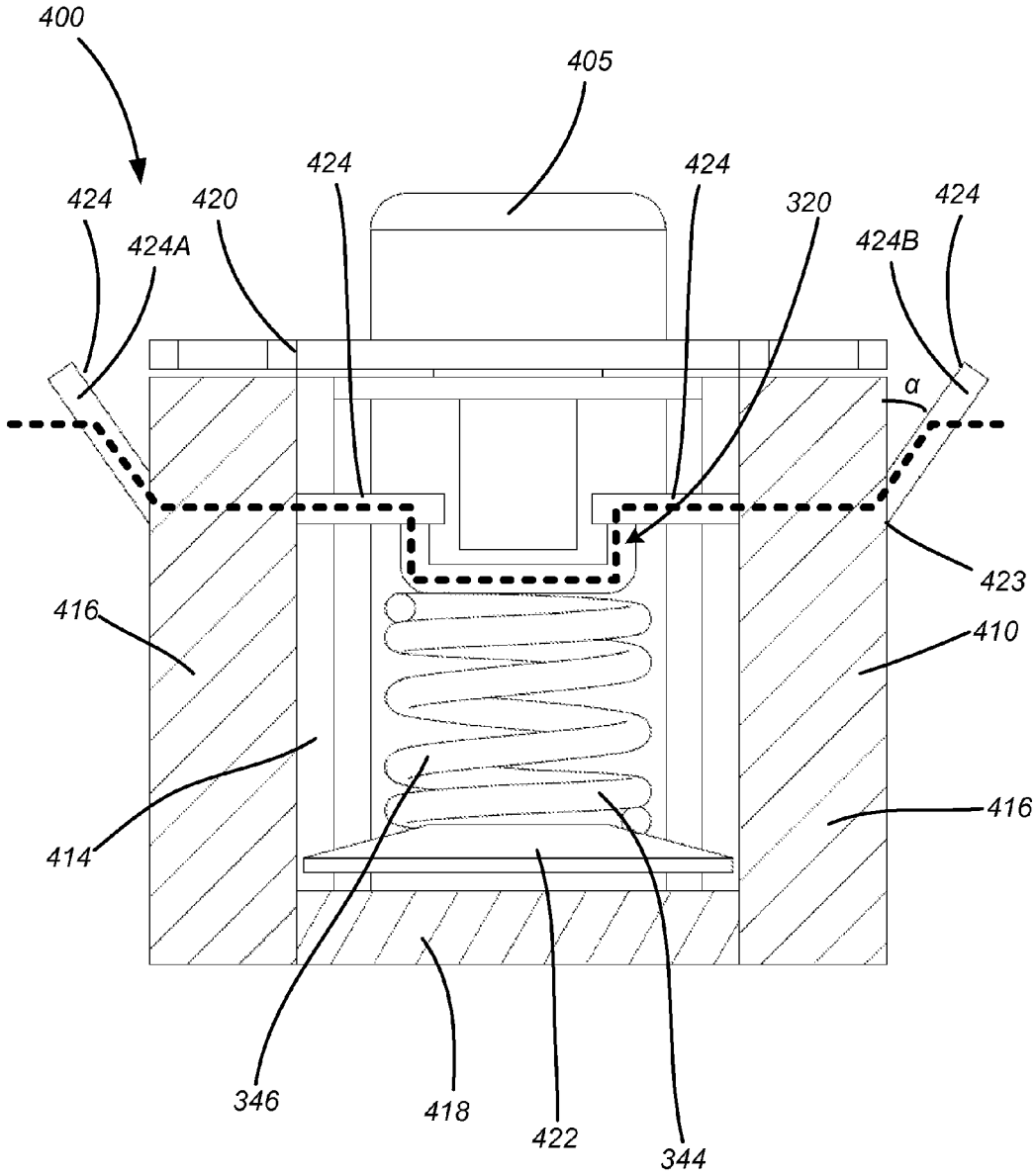
FIG. 21 illustrates a side, cross-sectional view of a bypass system for a lamp system, in accordance with an exemplary embodiment of the present invention.
Figure 22:
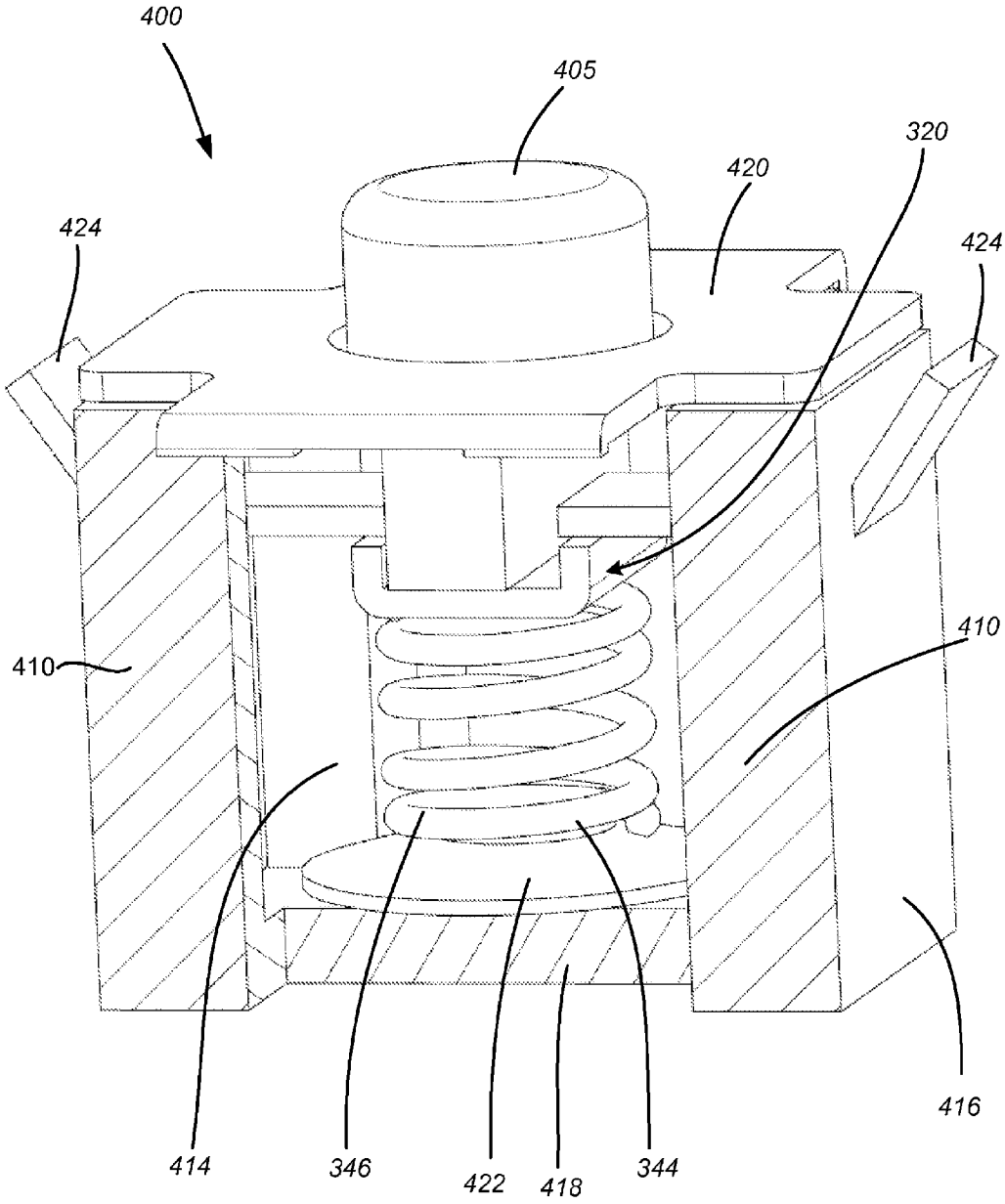
FIGS. 22-23 illustrate side, partial perspective, cross-sectional views of the bypass system of FIG. 21, in accordance with an exemplary embodiment of the present invention.

FIGS. 18-20 illustrate aspects of yet another lamp system. FIGS. 18-20 depict a sealing assembly 370 for sealing the socket 310. For instance, the sealing assembly 370 can protect the socket 310 from its environment. The sealing assembly 370 can limit, if not eliminate, moisture, water, and the like from entering the socket 310. Alternatively, the sealing assembly 370 can further act as a base support for the bypass mechanism 340.

The sealing assembly 370 can be positioned between the two wires 314 and beneath the bypass mechanism 340, as to not interfere with the bypass activating system engaging the bypass mechanism 340.

The sealing assembly 370 has a cup-like shape. A bottom of the sealing assembly 370 is substantially flat. A top of the sealing assembly 370 is open, for receiving the bypass mechanism 340, and sides of the sealing assembly 370 extend from the bottom to the top. The sealing assembly 370 can be made of plastic, and the sealing assembly 370 can be made of plastic, polymers, and the like.

FIGS. 21-29 illustrate another exemplary embodiment of the present invention, specifically, an integral bypass system 400 for insertion into a socket assembly 300. As shown in FIGS. 21-29, the bypass system 400 can be an integral, push-button bypass system 400. Use of the bypass system 400 can reduce manufacturing errors because assemblers of the lamp system 100 can insert the integral bypass system 400 into the socket assembly, instead of inserting multiple individual parts making up the bypass mechanism 320. As with the bypass mechanisms 320 described above, the integral bypass system 400 can enable energy to flow through a light string regardless of whether the light assembly 200 is working or properly seated.

The bypass system 400 can include an actuator 405 (or a bypass actuating system), a housing 410, the biasing member 344, and a bypass mechanism 320. The bypass system 400 improves upon the embodiments illustrated in FIGS. 9-11 and 18-20.

In FIGS. 21-29, the actuator 405 strikes the bypass mechanism 320, which can be a push-button, as the light assembly 200 is inserted into the socket 310. To permit movement of the bypass mechanism 320, the bypass mechanism 320 is in communication with the biasing member 344. Specifically, a downwardly extending member of the actuator 405 can strike the bypass mechanism 320 when the light assembly 200 is inserted into the socket 310.

The biasing member 344 can be, for example, a spring 346 or a topped, or a sheathed spring 346. The biasing member 344 can further be a zig-zag spring, a coiled spring, a hinge, and the like. The biasing member 344, in certain embodiments, shall not be conductive, while in other embodiments it is preferable to be conductive.

Similar to other embodiments described herein, the light assembly 200 is adapted to be inserted into the socket 310. The socket 310 defines an aperture sufficiently sized to receive the light assembly 200.

The housing 410 defines a cavity 414. The cavity 414 is formed by a number of side walls 416, a bottom portion 418, and a removable top portion 420. The removable top portion 420 can be a snap-cap, such that it snaps onto the housing 410, or more specifically, at least two opposing side walls 416. The cavity 414 is adapted to house and protect the biasing member 344 and the bypass mechanism 320.

A pair of conductive members 424 can positioned at a predetermined depth of the housing 410. The conductive members 424 are made of conductive material, e.g., metal, copper, and the like. The conductive members 424 extend inwardly from opposing sides of the housing 410, and are separated by a predetermined distance to permit receiving a portion of the base 220 of the light assembly 200. Further, a portion of the conductive member 424 can extend outside the housing 410, and at a given angle $\alpha$ relative to a side wall 416 of the housing. Each conductive member 424 can be a single component, such as a bent piece of copper, or a combination of connected components, such as two segments of copper attached to each other at a hinge or joint.

In an exemplary embodiment, the conductive members 424 can be flexible at a flexible point 423, such that the angle $\alpha$ can vary. This flexible point 423 can be a hinge or like device enabling the angle $\alpha$ to change relative to the side wall 416. This enables that upon insertion of the bypass system 400 into the fixed position within the socket 310, the conductive members 424 can flex when in contact with the contacting member 342.

Figure 23:
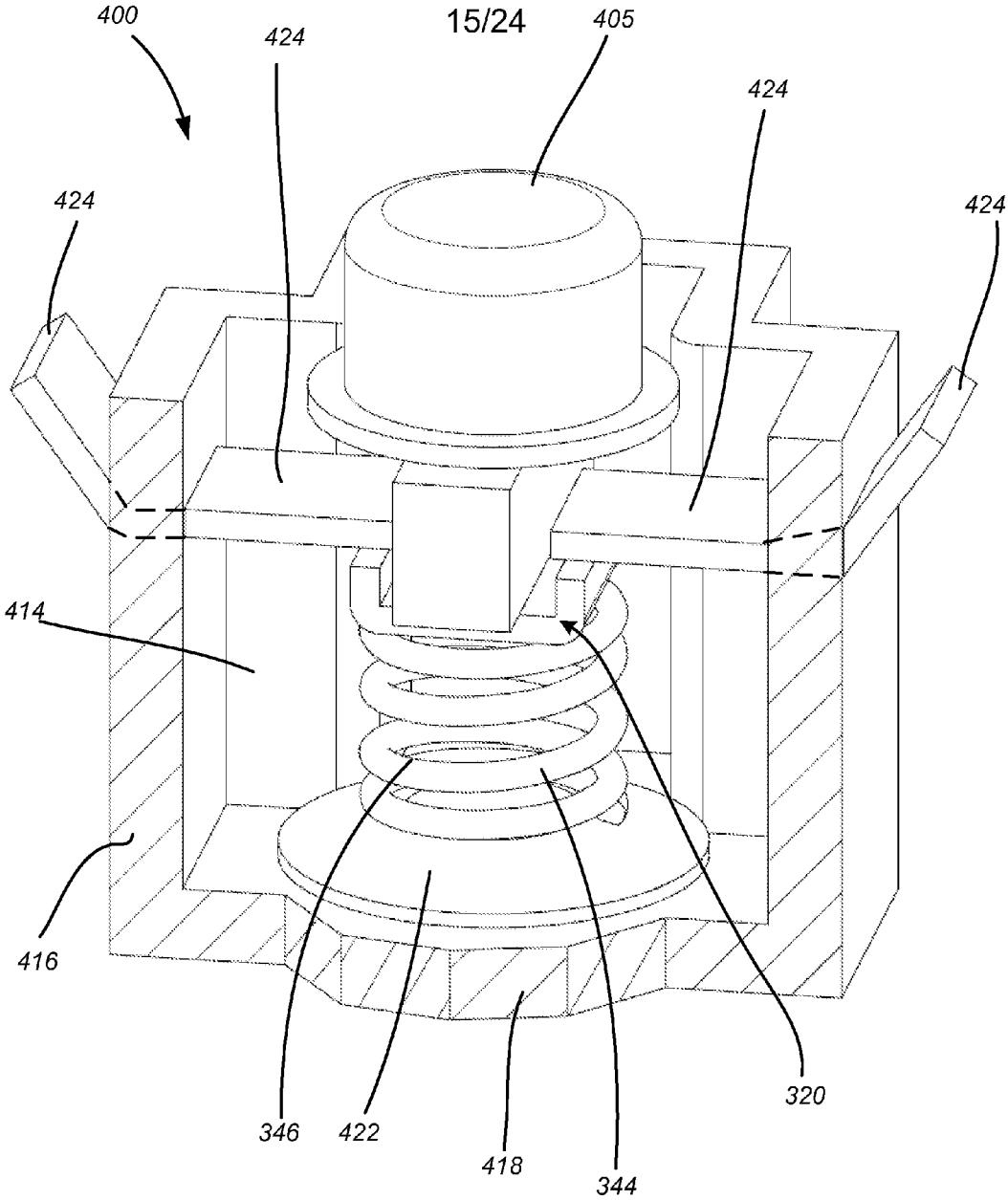
Figure 24:
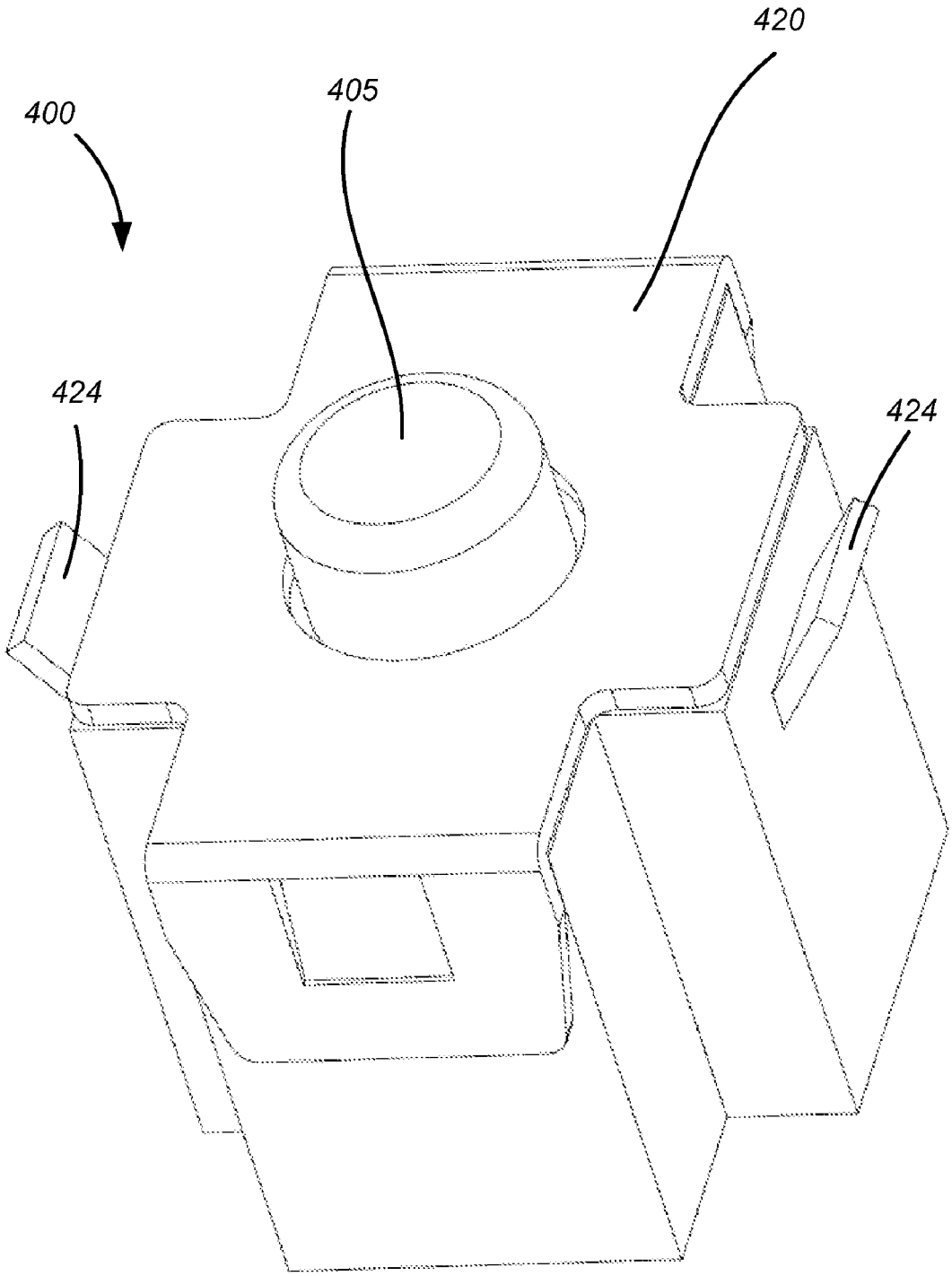
FIGS. 24-25 illustrate perspective views of the bypass system of FIGS. 21-23, in accordance with an exemplary embodiment of the present invention.
Figure 25:
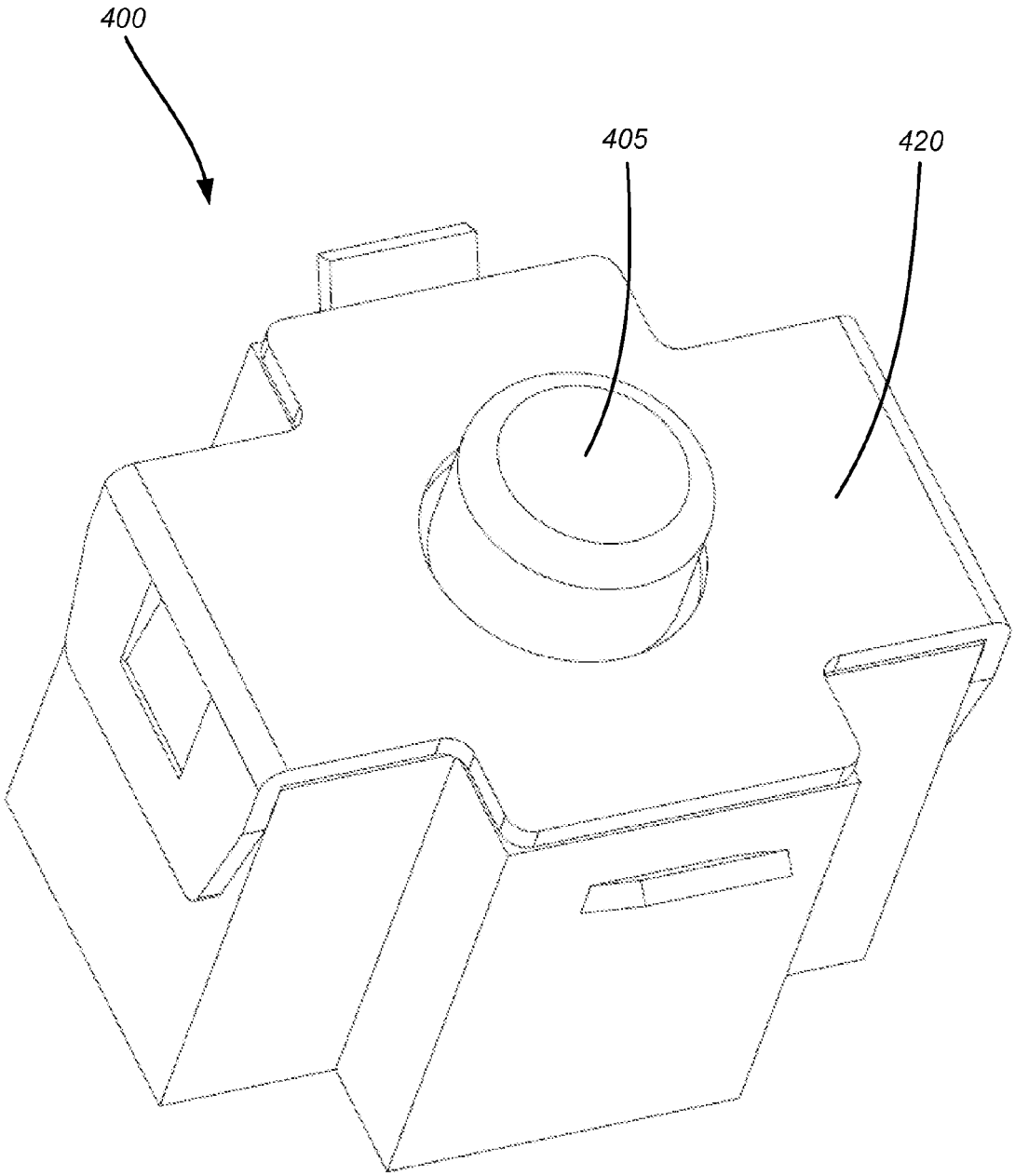
Figure 26:
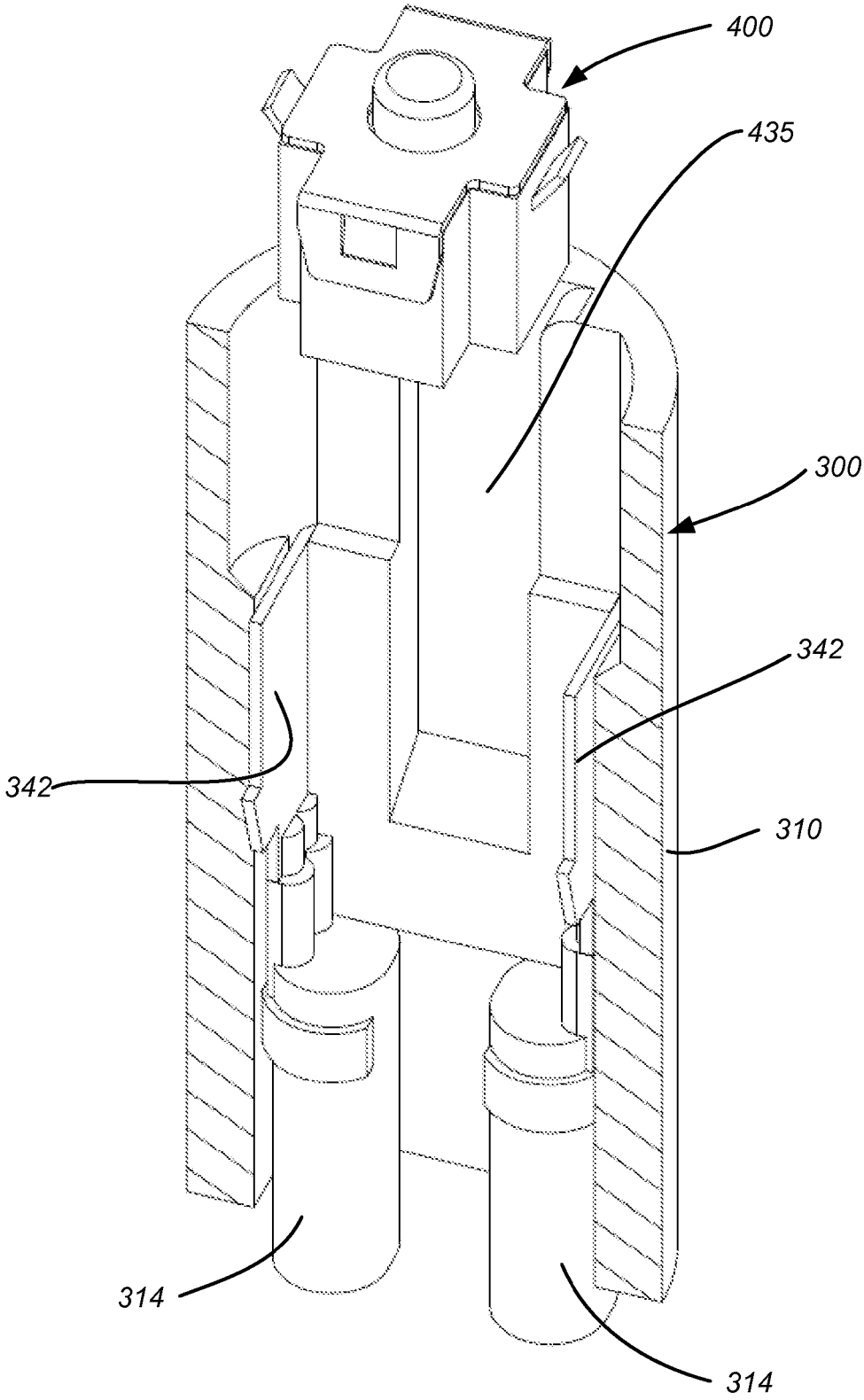
FIGS. 26-28 illustrate partial cross-sectional, perspective views of the bypass system of FIGS. 21-25 partially inserted into a socket, in accordance with an exemplary embodiment of the present invention.
Figure 27:
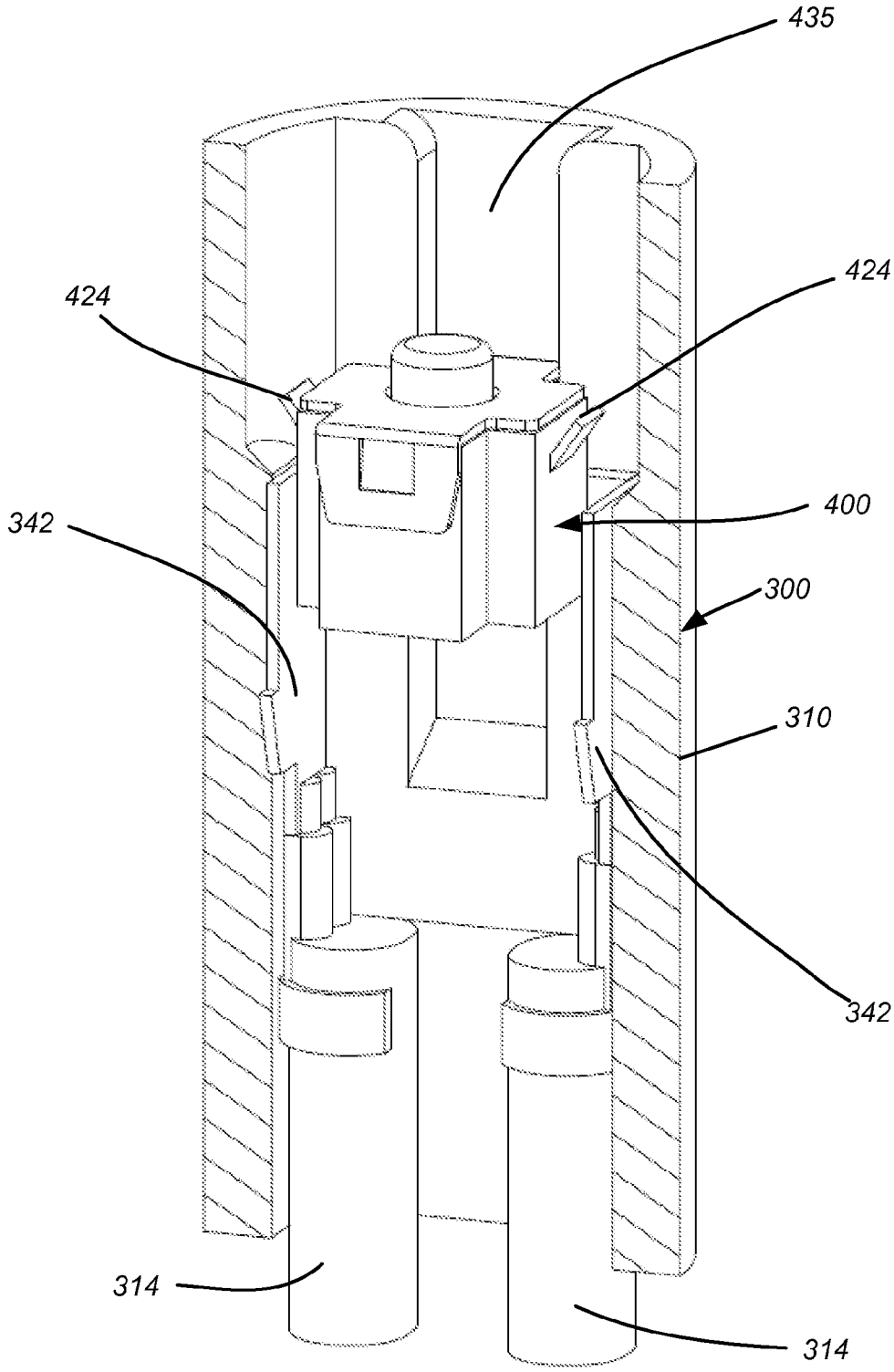
Figure 28:
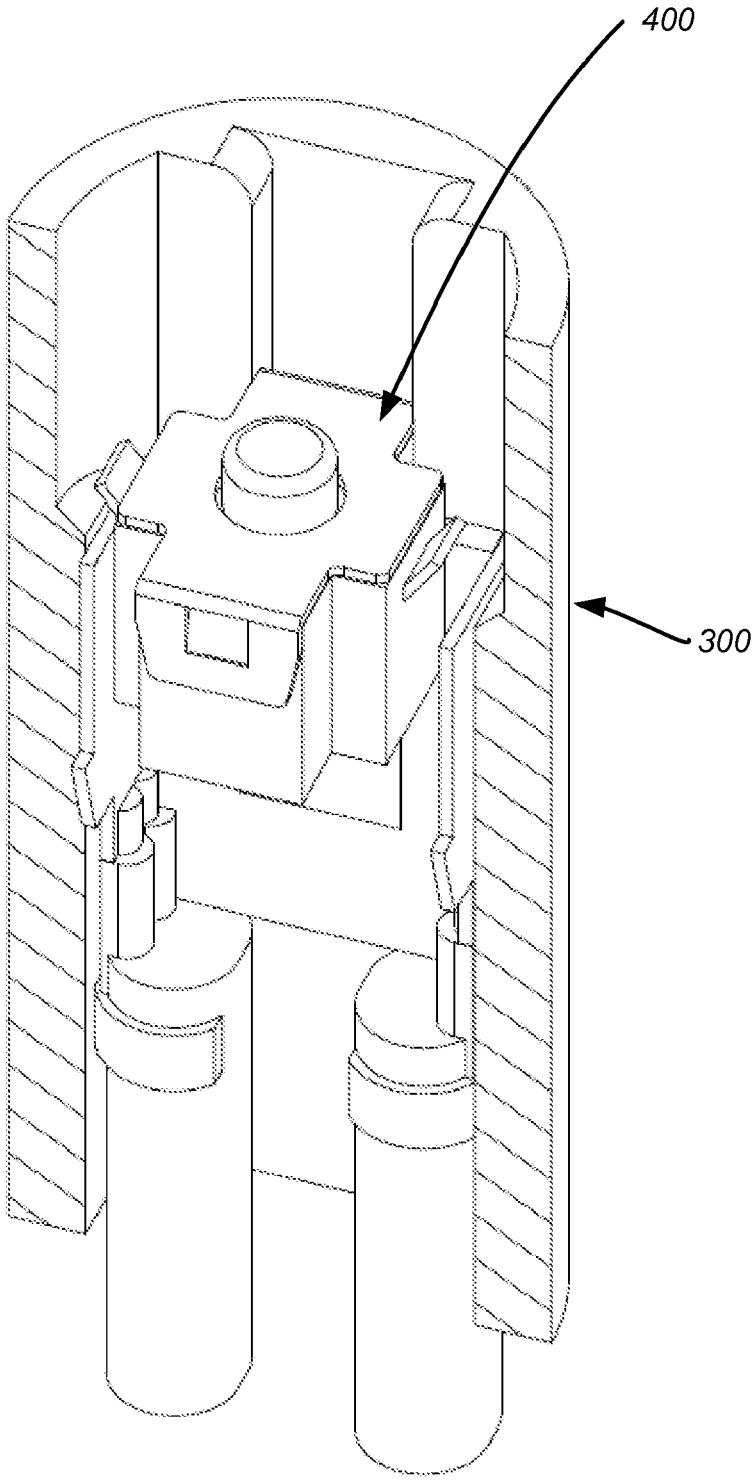
Figure 29:
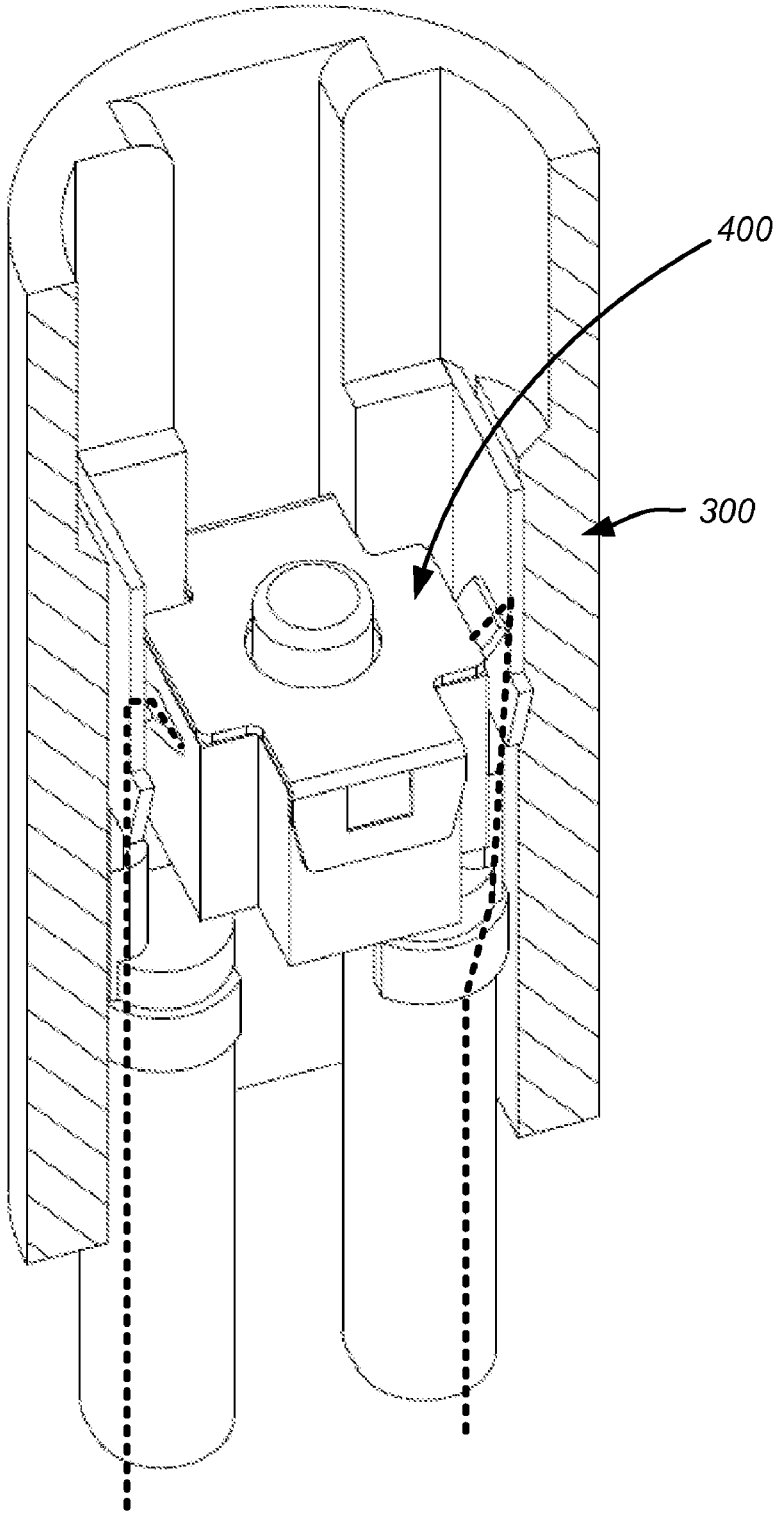
FIG. 29 illustrates a perspective view of the bypass system of FIGS. 21-25 fully inserted into the socket, in accordance with an exemplary embodiment of the present invention.

In an exemplary embodiment, the biasing member 344 rests within the cavity 414 of the housing 410. The biasing member 344 extends from the bypass mechanism 320, at a top point, to a base 422, at a bottom point. The base 422 can provide stability and structure to the biasing member 344. When the light assembly 200 is absent from the socket 310, the biasing member 344 is in a neutral, relaxed state. For example, when the light assembly 200 is absent from the socket 310, the spring 346 is at its equilibrium, i.e., not compressed or expanded, or is not entirely compressed. As a result, the bypass mechanism 320 is in contact with the conductive members 424, and energy can flow across the bypass mechanism 320 to "connect" the two conductive members 424. Upon insertion of the light assembly 200, and more specifically when the terminus of the base 220 of the light assembly 200 contacts the actuator 405, the actuator 405 is pushed downwardly (as depicted in FIG. 23) and causes the biasing member 344 to compress. As a result of this compression, the bypass mechanism 320 also moves downwardly, and away from the conductive member 424, and as a result energy can flow through the light assembly 200.

In other words, as the light assembly 200 is inserted into the socket 310, the base 220 of the light assembly 200 can contact the actuator 405, which can strike the bypass mechanism 320. In addition, the lead wires 222, which are extending from the base 220 of the light assembly 200, can contact the conductive members 424 enabling energy to flow through the light assembly 200.

In an exemplary embodiment, the bypass mechanism 320 includes two positions—a first position and a second position. The first position bypasses energy flow when the light assembly 200 is not seated in the socket 310. The second position of the bypass mechanism 320 enables energy to flow through the light source 210, therefore illuminating it.

In the embodiments depicted in FIGS. 21-29, the bypass mechanism 320 can be designed to move in an up and down motion, as the light assembly 200 is inserted into the socket 310. More specifically, the bypass mechanism 320 moves relative to—along the length of—the biasing member 344.

When the bypass mechanism 320 is in the first position, and as illustrated in FIGS. 21-29, energy flows from a first terminal wire 314 through a first conductive member 424A, which extends through a side wall 416, through the bypass mechanism 320, through the second conductive member 424B, and ultimately leaves the lamp system via the second terminal wire 314. When in the second position (not shown), energy flows from the first terminal wire 314 through the first conductive member 342 through the lead wires 222 of the light assembly 200 to illuminate the light assembly 200, and then through the second conductive member 342, and ultimately exits the lamp system 100 via the second terminal wire 314. This energy flow is illustrated by the dashed lines in FIGS. 21 and 29.

An advantage of the bypass system 400 is that it can be retrofitted to an existing socket assembly 300. In other words, the bypass system 400 can be dropped into an existing socket 310 and provide the necessary shunting characteristics to enable remaining light assemblies in the light string system to remain lit when a light assembly is missing or absent from a socket.

For example, in one embodiment, the bypass system 400 can slide into the socket assembly 300, and once its conductive members 424 make contact with of contacting members 342 the socket assembly 300 the shunt or bypass system can operate. In an exemplary embodiment, the socket 310 can include channels or grooves 435 that extend along its interior. The channels 435 can receive a portion of the bypass system 400. For example, the bypass system 400 can have a shape of plus sign (+), wherein at least two of the opposing ends of the plus shape can be received by the channels 435 for securing the bypass system 400 within the socket 310.

Improving on the embodiments described in FIGS. 9-11 and 18-20, which could be defective due to the improper installation of the biasing member in the socket, the embodiments of FIGS. 21-29 help stabilize the biasing member. In particular, installation of the biasing member of FIGS. 9-11 and 18-20 may fail because manual installers could cheat and thus skip putting the spring into the finished design. In the embodiments of FIGS. 21-29, the biasing member is provided in the housing, and thus avoids the need of the installer to install the biasing member, as the installer needs to install the bypass system 400 itself, which already contains biasing member and the circuitry for the shunting characteristics.

In the embodiments of FIGS. 21-29, the light string remains lit even if there is (1) a broken bulb, (2) a loose or lost bulb, or (3) a loose or lost bulb and broken base. In conventional designs, if the bulb was broken, the bulb base could remain in the socket and the connection would not be made because the biasing member remained depressed. As a result, the current could not flow through the bulb as it was broken. In the embodiments of FIGS. 21-29, even if the bulb is broken and the base is properly seated, the light string system will remain illuminated.

Figure 30B:
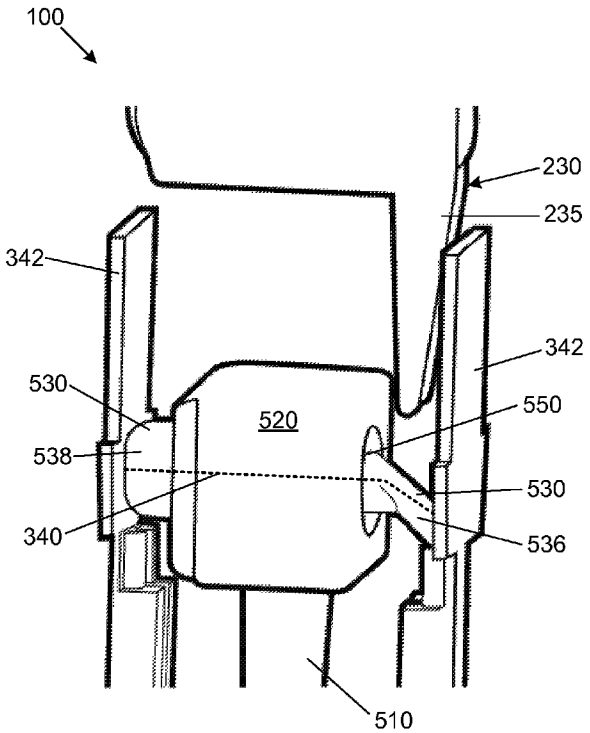
FIGS. 30A-30C illustrate cross-sectional views of a portion of another embodiment of the lamp system.
Figure 30A:
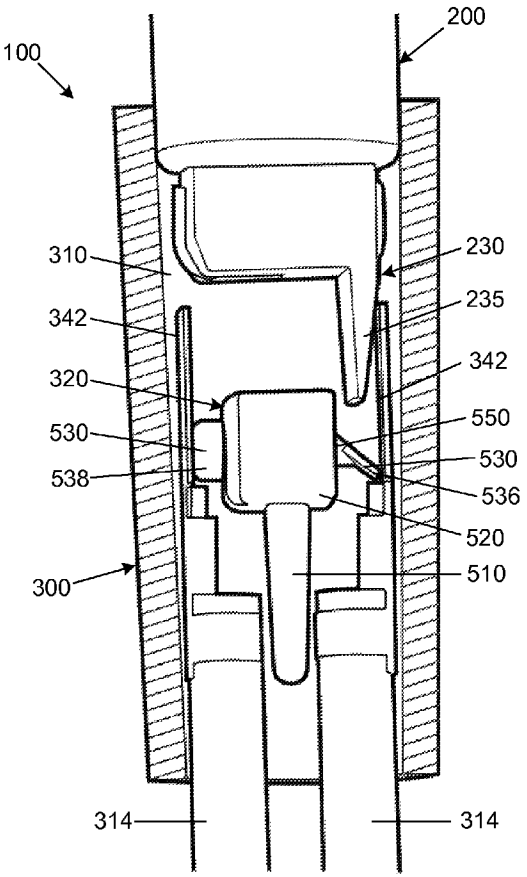
Figure 30C:
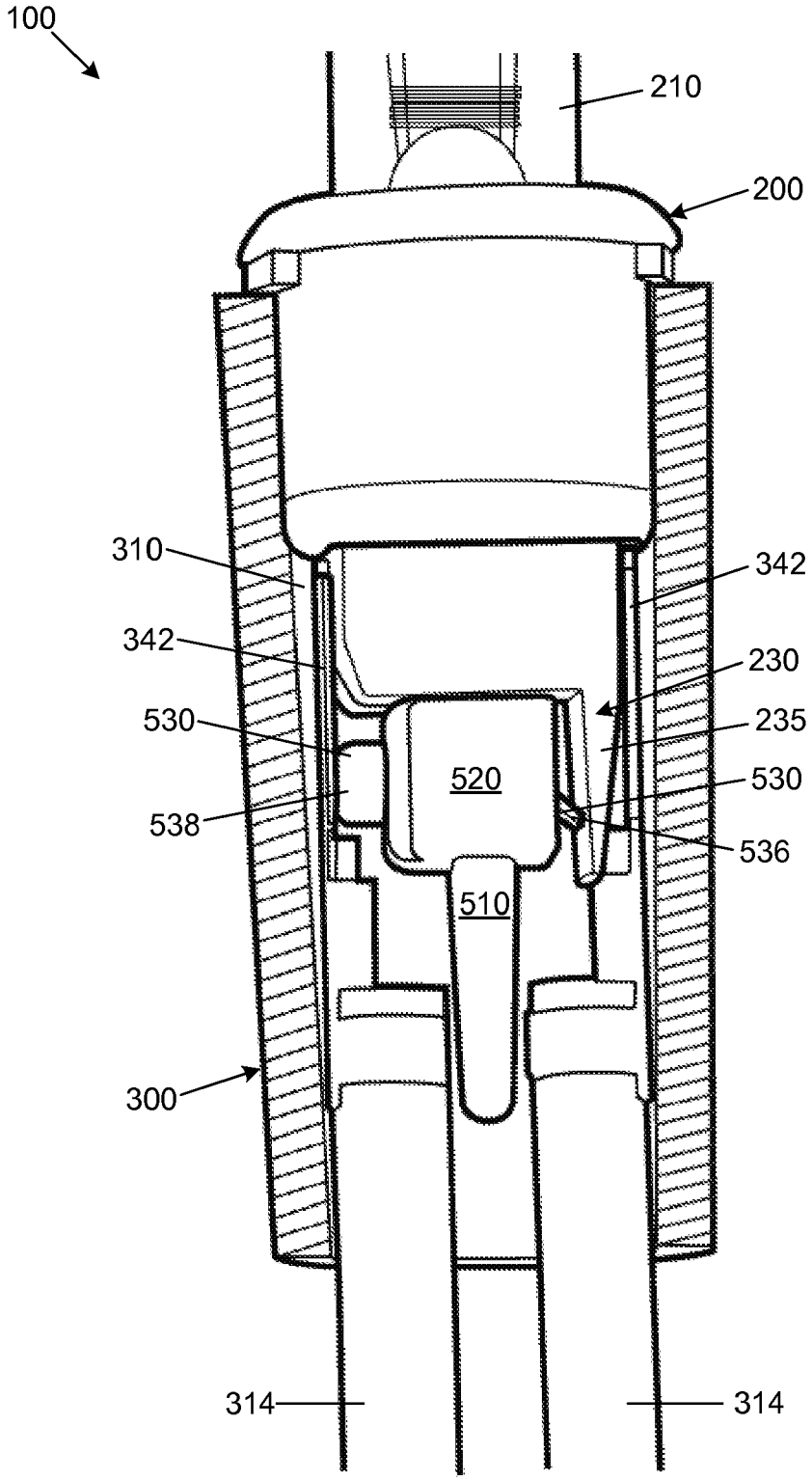

FIGS. 30A-30C illustrate portions of yet another exemplary embodiment of the lamp system 100. More specifically, FIGS. 30A-30B show portions of a lamp system 100 having its bypass mechanism 320 in the first position, while FIG. 30C shows the bypass mechanism being in the second position. As shown in FIGS. 30A-30C, the bypass mechanism 320 can include a bypass support 510, a cabinet 520, at least one extending member 530, and a conductive element 540 (FIG. 30B).

The support 510 can extend downward to an interior surface of the socket 310, so as to support the bypass mechanism 320 within the socket 310. The bypass support 510 can have various shapes and configurations. For example, as shown, the bypass support 510 can be an extending member extending generally downwardly from the cabinet 520.

The cabinet 520 can be supported within the socket 310 by the bypass support 510. The cabinet can hold one or more components for operating the extending members 530 or other aspects of the bypass mechanism 320. As shown in the figures, the cabinet 520 can be in the shape of a polyhedron, such as a rectangular prism, cube, or other polyhedron, but other shapes can be provided for the cabinet 520 as well. In an exemplary embodiment, the top surface 525 of the cabinet has a shape complimentary to the shape of an underside of the light assembly 200, such that the light assembly 200 can be seated in the socket assembly 300 atop the bypass mechanism 320.

One or more extending members 530 can extend from the cabinet 520. More specifically, in an exemplary embodiment, each of first and second extending members 530 can extend from opposing sides of the cabinet 520. The opposing sides of the cabinet 520 can face outwardly toward the contacting members 342 of the socket assembly 300. When the light assembly 200 is unseated, both extending members 530 can extend outwardly from the cabinet, such that the far ends 532 of the extending members 530 contact the contacting members 342 of the socket assembly 300 when the bypass mechanism is in the first position.

At least one of the extending members 530 can be moveable to displace the extending members 530 from contact with the contacting members 342. In the embodiment of FIGS. 30A-30B, the first extending member 536 is moveable, but the second extending member 538 can be substantially immobile. In some exemplary embodiments, the cabinet 520, the first extending member 536, and the second extending member 538 can be distinct components connected together to enable these components to move relative to one another as needed for operation of the bypass mechanism 320.

A moveable extending member 530, such as the first extending member 536, can be pivotably attached to the cabinet 520. For example, the extending member 530 can connect to the cabinet 520 by a joint 550, a hinge, or a bias member, such as a spring. The joint 550 can enable the extending member 530 to pivot relative to the cabinet 520, while the cabinet 520 remains stationary, or substantially so, within the socket 310. In some embodiments, the joint 550 can be positioned inside a cavity of the cabinet 520, from which the extending member 530 extends outward, or alternatively, the joint can be positioned on an outside surface of the cabinet 520.

As shown in FIGS. 30A-30C, the extending member 530 can extend outwardly from the cabinet 520, and the angle the extending member 530 makes with the cabinet 520 can change depending on whether the bypass mechanism 320 is in the first or second position. For example, as further shown, the extending member 530 can extend downwardly, as well as outwardly, to create an acute angle with a lower portion of the cabinet 520. When the bypass mechanism 320 is in the second position, the angle between the extending member 530 and the cabinet 520 can become smaller, and the extending member 530 can be angled downwardly at a deeper angle. The change in orientation of the extending member 530 during transition from the first position or the second position can cause the extending member 530 to separate from the contacting member 342. This separation stops current from flowing between the contacting members 342 by way of the bypass mechanism 320.

The conductive element 540 (FIG. 30B) can extend from an end of the first extending member 536, through the cabinet 520, and through the second extending member 538 to an end of the second extending member 538. The conductive element 540 can have various configurations incorporating the cabinet 520 and the extending members 530. For example, and not limitation, the extending members 530 themselves can be conductive, and a wire or other conductive component can extend through the cabinet 520 connecting the first and second extending members 530. In that case, the conductive element 540 comprises the first and second extending members 530 and the wire or other conductive component. Alternatively, a wire or other conductive member can extend all the way through the first extending member 536, the cabinet 520, and the second extending member 538. In that case, the conductive element 540 can be that wire or other conductive component. Regardless of the configuration, the conductive element 540 can create a short circuit to pass current between the contacting members 342 with the extending members 530 are extended, such as in the first position of the bypass mechanism 320.

The bypass activating system 230 of the light assembly 100 can comprise one or more separating members 235 configured to separate at least the first extending member 530 of the bypass mechanism 320 from its corresponding contacting member 342 of the socket assembly 300. When the light assembly 200 is inserted into the socket assembly 300, the separating member 235 can push the extending member 530 downward, thereby tilting the extending member 530 further downward and separating the extending member 530 from the contacting member 342. For example, as shown in the figures, the extending member 530 can be a switch moveable between up and down positions, and the separating member 235 can push the extending member 530 into the down position. As a result, the bypass mechanism 320 is moved from the first position to the second position upon insertion of the light assembly 200.

When the bypass mechanism 320 is in the first position, energy can flow from the left terminal wire 314 to the left contacting member 342, through the left extending member 538, through the cabinet 520, through the right extending member 536, to the right contacting member 342, and then to the right terminal wire 314. Alternatively, this current flow can be reversed if current flows in the opposite direction through a light string. In the first position, the bypass mechanism 320 can act like a shunt to connect the two contacting members 342. When the light assembly 200 is inserted into the socket to place bypass mechanism 320 in the second position, the bypass activating system 230 can push the extending member 530 away from the corresponding contacting member 342 to disable the shunt. At least a portion of the bypass activating system 230 can be insulative, thereby prohibiting energy from flowing through the bypass mechanism 320 when the bypass mechanism is in the second position. When the bypass mechanism 320 is in the second position, energy is directed from the first contacting member 342 and through the lead wires 222 to illuminate the light source 210.

In some exemplary embodiments in which the second extending member 538 is substantially immobile, the bypass mechanism 320 can be moved to the second position only when the light assembly 200 is inserted into the socket assembly, such that the separating member 235 is aligned with the first extending member 536. In that case, the light assembly 200 cannot be properly seated in the socket assembly 300 when the separating member is aligned with the second extending member 538, because the second extending member 538 cannot move to provide a space for insertion of the separating member 235.

Figure 31B:
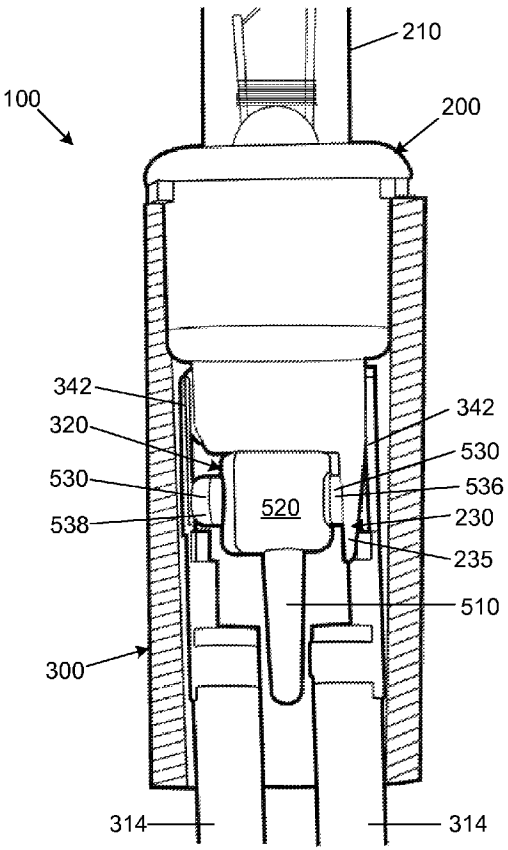
FIGS. 31A-31B illustrate cross-sectional views of a portion of yet another embodiment of the lamp system.
Figure 31A:
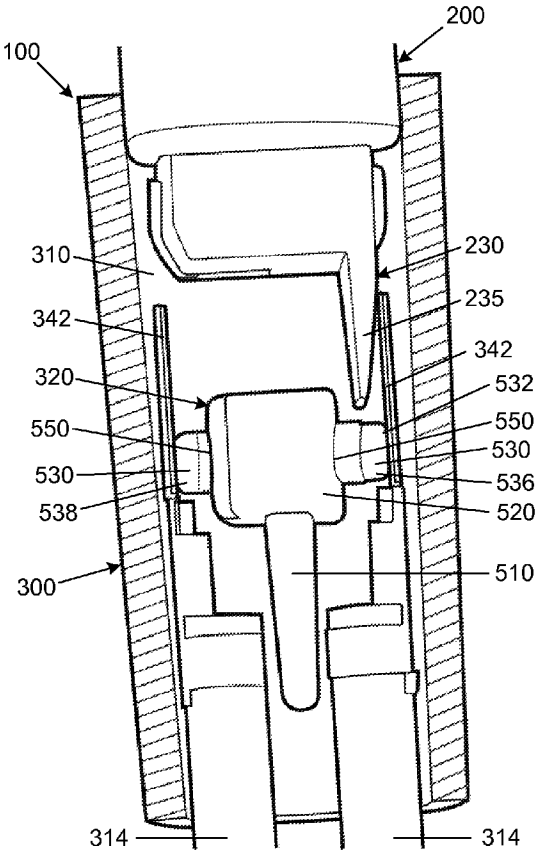

FIGS. 31A-31B illustrate another exemplary embodiment of the lamp assembly 200. The embodiment of FIGS. 31A-31B is based on the embodiment of FIGS. 30A-30C, and can have the same or similar components. In the embodiment of FIGS. 31A-31B, however, both the first and second extending members 536 and 538 can be moveable to place the bypass mechanism 320 in the second position.

As shown, one or more of the extending members 530 can attach to the cabinet 520 at one or more joints 550, and can be retractable or moveable at the joints 550. For example, and not limitation, an extending member can be a ball component, similar to the ball component at the tip of a ball pint pen. When the extending member 530 is pushed downward or inward, such as by a separating member 235, the ball component can move or retract toward the cabinet and away from its corresponding contacting member 342. Alternatively, an extending member 530 can be a button, and depression of the extending member 530 can cause the button to retract toward the cabinet 520. The cabinet 520 can define a cavity or opening, which can be aligned with the extending member 530, into which all or a portion of the extending member 530 can be received when the extending member 530 is pushed toward the cabinet 520. Further alternatively, one or both of the extending members 530 can be shaped and configured similar to the first extending member 536 of FIGS. 30A-30C. Retraction or movement of the extending member 530 toward or into the cabinet 520 can separate that extending member 530 from its corresponding contacting member 342, thereby interrupting current flow through the bypass mechanism.

When the light assembly 200 is inserted into the socket assembly 300, at least one separating member 235 can separate at least one extending member 530 from a corresponding contacting member 342. The far end 532 of an extending member 530 can be curved or otherwise bent or slanted to enable the separating member 235 to be inserted between the extending member 530 and the contacting member 342 of the socket assembly 300. When the light assembly 200 is inserted, the separating member 235 can push the extending member 530 aside, causing the extending member 530 to retract into the cabinet 520. Thus, the bypass mechanism is placed into the second position. As a result, when the light assembly 200 is inserted, current is unable to flow from the left terminal wire 314 through the bypass mechanism 320, and the short circuit created by the bypass mechanism 320 is be broken.

To stop the flow of current through the bypass mechanism 320, only one of the extending members 530 need be separated from a contacting member 342. Therefore, only a single separating member 235 need be provided in the bypass activating system 230 regardless of whether one or both of the extending members 530 of the bypass mechanism 320 are moveable. The bypass mechanism 320 can be placed in the second position regardless of which extending member 530 is pushed aside by the bypass activating system 230. Accordingly, when a single separating member 235 is provided, the bypass mechanism 320 can be placed in the second position when the light assembly 200 is oriented to align the separating member 235 with the first extending member 536 and, in other instances, when the separating member 235 is aligned with the second extending member 538. In some alternative exemplary embodiments, however, a separating member 235 can be provided for each extending member 530.

As described above, various embodiments of the present invention can be bypass systems and mechanisms, lamp systems, and light strings.

An exemplary embodiment of a lamp string according to the present invention can comprise a light assembly, a socket assembly, and a bypass mechanism.

The light assembly can include a light source and a base, where the base comprises a bypass activating system. The bypass activating system can comprise a first separating member extending downwardly from the base of the light assembly. The socket assembly can comprise a socket dimensioned to receive via insertion the base of the light assembly.

The socket assembly can include first and second contacting members positioned proximate opposing sides of the socket. The bypass mechanism can extend from the first contacting member of the socket assembly to the second contacting member of the socket assembly, and can be moveable between a first position and a second position.

The bypass mechanism can include a cabinet, a first extending member, and an optional second extending member. The cabinet can have opposing first and second sides, positioned such that the first side faces the first contacting member of the socket assembly. The first extending member can be attached to the cabinet at a joint, wherein the first extending member is moveable while the cabinet remains substantially stationary relative to the socket. The first extending member can be configured to extend from the first side of the cabinet to the first contacting member of the socket assembly when the bypass mechanism is in the first position. The first extending member can be moveably attached to the cabinet, such that an end of the first extending member can be pushed downwardly away from the first contacting member to separate the first extending member from the first contacting member. In some exemplary embodiments, a second extending member is provided, and can interact with the second side of the cabinet and the second contacting member in a manner similar to how the first extending member interacts with the first side of the cabinet and the first contacting member.

Current flow is bypassed from the light assembly and across the socket assembly through the first bypass mechanism when the bypass mechanism is in the first position. Conversely, when the bypass mechanism is in the second position, current flow is directed through the light assembly. Upon insertion of the base of the light assembly into the socket assembly, the first separating member can separate the first extending member of the bypass mechanism from the first contacting member of the socket assembly, thereby placing the bypass mechanism in the second position. Further, upon removal of the base of the light assembly from the socket assembly, the first extending member resumes contact with the first contacting member, once again placing the bypass mechanism in the first position.

An integral bypass system according to the present invention can be configured to be integrally inserted into a socket of a lamp assembly. Such an integral bypass system can comprise a housing, a cap, first and second conductive members, a bypass mechanism, a biasing member, and an actuator.

The housing can have a lower closed end, and opposing first and second peripheral walls extending upwardly from the lower closed end. The housing can define an opening to a cavity inside the housing. The cap can be securable to the housing over the opening.

The first conductive member of the bypass system can extend from inside the housing through the first peripheral wall of the housing, while the second conductive member can extend from inside the housing through the second peripheral wall of the housing. Inside the cavity of the housing, the first conductive member and the second conductive member can be separated by a predetermined distance.

The bypass mechanism can be positioned inside the cavity of the housing, and can have a first position and a second position. In the first position, the bypass mechanism contacts both the first and second conductive members, and is configured to carry current between the first and second conductive members. Conversely, in the second position, the bypass mechanism does not contact the first conductive member and, therefore, cannot carry current between the first and second conductive members.

The compressible biasing member can reside inside the cavity of the housing to support the bypass mechanism within the cavity.

The actuator can be in communication with the bypass mechanism. The actuator can extend from inside the cavity of the housing through the cap when the cap is secured over the housing. The actuator can be configured to push the bypass mechanism downwardly into the compressible biasing member. Thus, the actuator can cause the compressible biasing member to compress, which displaces the bypass mechanism from the first conductive member, thereby placing the bypass mechanism in the second position.

While exemplary embodiments of the invention have been disclosed many modifications, additions, and deletions can be made therein without departing from the spirit and scope of the invention and its equivalents, as set forth in the following claims.

What is claimed is:

1. A bypass system for a lamp system, the bypass system comprising:

a housing having a lower closed end, and opposing first and second peripheral walls extending upwardly from the lower closed end, the housing defining an opening to a cavity inside the housing;

a cap securable to the housing over the opening;

a first conductive member extending from inside the housing through the first peripheral wall of the housing;

a second conductive member extending from inside the housing through the second peripheral wall of the housing, the first conductive member and the second conductive member being separated by a predetermined distance within the cavity of the housing;

a bypass mechanism inside the cavity of the housing and having a first position and a second position, wherein in the first position, the bypass mechanism contacts both the first and second conductive members and is configured to carry current between the first conductive member and the second conductive member, and wherein in the second position, the bypass mechanism does not contact the first conductive member;

a compressible biasing member for supporting the bypass mechanism within the cavity of the housing; and an actuator in communication with the bypass mechanism and extending from inside the cavity of the housing through the cap, when the cap is secured over the housing, the actuator being configured to push the bypass mechanism downwardly into the compressible biasing member, thereby causing the compressible biasing member to compress and displacing the bypass mechanism from the first conductive member, thereby placing the bypass mechanism in the second position; and wherein the bypass system is configured for integral insertion into a socket of a lamp system.

2. A lamp system comprising the bypass system of claim 1.

3. A light string system comprising a plurality of lamp systems of claim 2.

4. A bypass system for a lamp system, the bypass system comprising:

a housing having a lower closed end, and opposing first and second peripheral walls extending upwardly from the lower closed end, the housing defining an opening to a cavity inside the housing;

a cap securable to the housing over the opening;

a first conductive member extending from inside the housing through the first peripheral wall of the housing;

a second conductive member extending from inside the housing through the second peripheral wall of the housing, the first conductive member and the second conductive member being separated by a predetermined distance within the cavity of the housing;

a bypass mechanism inside the cavity of the housing and having a first position and a second position, wherein in the first position, the bypass mechanism contacts both the first and second conductive members and is configured to carry current between the first conductive member and the second conductive member, and wherein in the second position, the bypass mechanism does not contact the first conductive member;

a compressible biasing member for supporting the bypass mechanism within the cavity of the housing; and wherein the bypass system is configured for integral insertion into a socket of a lamp system.

5. The bypass system of claim 4, further comprising an actuator in communication with the bypass mechanism and extending from the cap into the cavity of the housing when the cap is secured to the housing over the opening.

6. The bypass mechanism of claim 5, wherein the actuator pushes the bypass mechanism downwardly into the compressible biasing member to compress and displace the bypass mechanism from the first conductive member, thereby placing the bypass mechanism in the second position.

7. The bypass system of claim 4, wherein the compressible biasing member is selected from the group consisting of a spring, a topped spring, a sheathed spring, a zig-zag spring, a coiled spring, and a hinge.

8. The bypass system of claim 4, wherein the compressible biasing member is conductive.

9. The bypass system of claim 4, wherein the first conductive member or the second conductive member are flexible at a flexible point so that the first conductive member or the second conductive member flex when in contact with the first contacting member or the second contacting member.

10. The bypass system of claim 9, wherein the flexible point is a hinge.

11. The bypass system of claim 4, wherein the cavity is adapted to house and protect the compressible biasing member and the bypass mechanism.

12. A bypass system for a lamp system, the lamp system including a light assembly having a light source and a base, the lamp system further including a socket assembly having a socket dimensioned to receive via insertion the base of the light assembly, the socket assembly including first and second contacting members positioned proximate opposing sides of the socket, the bypass system comprising:

a bypass mechanism configured to extend from the first contacting member of the socket assembly to the second contacting member of the socket assembly, and moveable between a first position and a second position;

a cabinet having opposing first and second sides, the first side facing the first contacting member; and a first extending member attached to the cabinet at a joint, wherein the first extending member is moveable while the cabinet remains substantially stationary relative to the socket, the first extending member being configured to extend from the first side of the cabinet to the first contacting member of the socket assembly when the bypass mechanism is in the first position;

wherein current flow is bypassed from the light assembly and across the socket assembly through the bypass mechanism when the bypass mechanism is in the first position, wherein in the second position, current flow is directed through the light assembly, wherein upon insertion of the base of the light assembly into the socket assembly, the first separating member separates the first extending member of the bypass mechanism from the first contacting member of the socket assembly, thereby placing the bypass mechanism in the second position, and wherein upon removal of the base of the light assembly from the socket assembly, the first extending member resumes contact with the first contacting member, wherein the bypass mechanism is placed in the first position.

* * * * *